US011652264B2

(12) United States Patent
Dogiamis et al.

(10) Patent No.: US 11,652,264 B2
(45) Date of Patent: *May 16, 2023

(54) MICROELECTRONIC ASSEMBLIES WITH SUBSTRATE INTEGRATED WAVEGUIDE

(71) Applicant: Intel Corporation, Santa Clara, CA (US)

(72) Inventors: Georgios Dogiamis, Chandler, AZ (US); Adel A. Elsherbini, Tempe, AZ (US)

(73) Assignee: Intel Corporation, Santa Clara, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/582,271

(22) Filed: Jan. 24, 2022

(65) Prior Publication Data

US 2022/0149500 A1 May 12, 2022

Related U.S. Application Data

(63) Continuation of application No. 15/972,441, filed on May 7, 2018, now Pat. No. 11,264,687.

(30) Foreign Application Priority Data

Apr. 3, 2018 (GR) ..... 20180100144

(51) Int. Cl.

| | |
|---|---|
| ***H01P 1/208*** | (2006.01) |
| ***H01P 3/12*** | (2006.01) |
| ***H01P 11/00*** | (2006.01) |
| ***H01P 5/10*** | (2006.01) |
| ***H01P 1/20*** | (2006.01) |
| ***H01P 7/06*** | (2006.01) |
| ***H01P 1/213*** | (2006.01) |

(Continued)

(52) U.S. Cl.

CPC ..... *H01P 1/2088* (2013.01); *H01P 1/2002* (2013.01); *H01P 1/2138* (2013.01); *H01P 3/121* (2013.01); *H01P 5/10* (2013.01); *H01P 5/12* (2013.01); *H01P 7/065* (2013.01); *H01P 11/002* (2013.01); *H01P 11/007* (2013.01); *H01P 11/008* (2013.01); *H01P 5/16* (2013.01)

(58) Field of Classification Search

CPC ..... H01P 1/2088; H01P 1/2002; H01P 3/122; H01P 1/2138

USPC ..... 333/208

See application file for complete search history.

(56) References Cited

U.S. PATENT DOCUMENTS

| | | | |
|---|---|---|---|
| 5,382,931 | A | 1/1995 | Piloto et al. |
| 6,724,283 | B2 | 4/2004 | Bergstedt et al. |
| 7,009,470 | B2 | 3/2006 | Yatabe et al. |

(Continued)

*Primary Examiner* — Benny T Lee

(74) *Attorney, Agent, or Firm* — Akona IP PC

(57) ABSTRACT

Microelectronic assemblies that include a lithographically-defined substrate integrated waveguide (SIW) component, and related devices and methods, are disclosed herein. In some embodiments, a microelectronic assembly may include a package substrate portion having a first face and an opposing second face; and an SIW component that may include a first conductive layer on the first face of the package substrate portion, a dielectric layer on the first conductive layer, a second conductive layer on the dielectric layer, and a first conductive sidewall and an opposing second conductive sidewall in the dielectric layer, wherein the first and second conductive sidewalls are continuous structures.

20 Claims, 12 Drawing Sheets

(51) Int. Cl.
*H01P 5/12* (2006.01)
*H01P 5/16* (2006.01)

(56) References Cited

U.S. PATENT DOCUMENTS

| | | | |
|---|---|---|---|
| 7,142,074 | B2 | 11/2006 | Kim et al. |
| 8,130,063 | B2 | 3/2012 | Chen et al. |
| 11,264,687 | B2 * | 3/2022 | Dogiamis et al. ..... H01P 5/10 |
| 2001/0000429 | A1 | 4/2001 | Arakawa et al. |
| 2004/0119564 | A1 | 6/2004 | Itoh et al. |
| 2015/0295294 | A1 | 10/2015 | Rogozine et al. |
| 2016/0036110 | A1 | 2/2016 | Cheng et al. |
| 2017/0092412 | A1 | 3/2017 | Manusharow et al. |
| 2017/0093007 | A1 | 3/2017 | Elsherbini et al. |
| 2018/0191047 | A1 | 7/2018 | Huang et al. |
| 2019/0305396 | A1 | 10/2019 | Dogiamis et al. |

* cited by examiner

MICROELECTRONIC ASSEMBLIES WITH SUBSTRATE INTEGRATED WAVEGUIDE

CROSS REFERENCE TO RELATED APPLICATION

This Application is a continuation (and claims benefit of priority under 35 U.S.C. § 120) of U.S. application Ser. No. 15/972,441, filed May 7, 2018, entitled "MICROELECTRONIC ASSEMBLIES COMPRISING A PACKAGE SUBSTRATE PORTION INTEGRATED WITH A SUBSTRATE INTEGRATED WAVEGUIDE FILTER," now U.S. Pat. No. 11,264,687, which claims the benefit of Greek Patent Application 20180100144, filed Apr. 3, 2018, the entire contents of which are hereby incorporated by reference.

BACKGROUND

Substrate integrated waveguides (SIWs) are waveguide structures formed in a substrate of an electronic circuit, including a printed circuit board (PCB), a package substrate, or any other process of planar circuit fabrication.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1A:
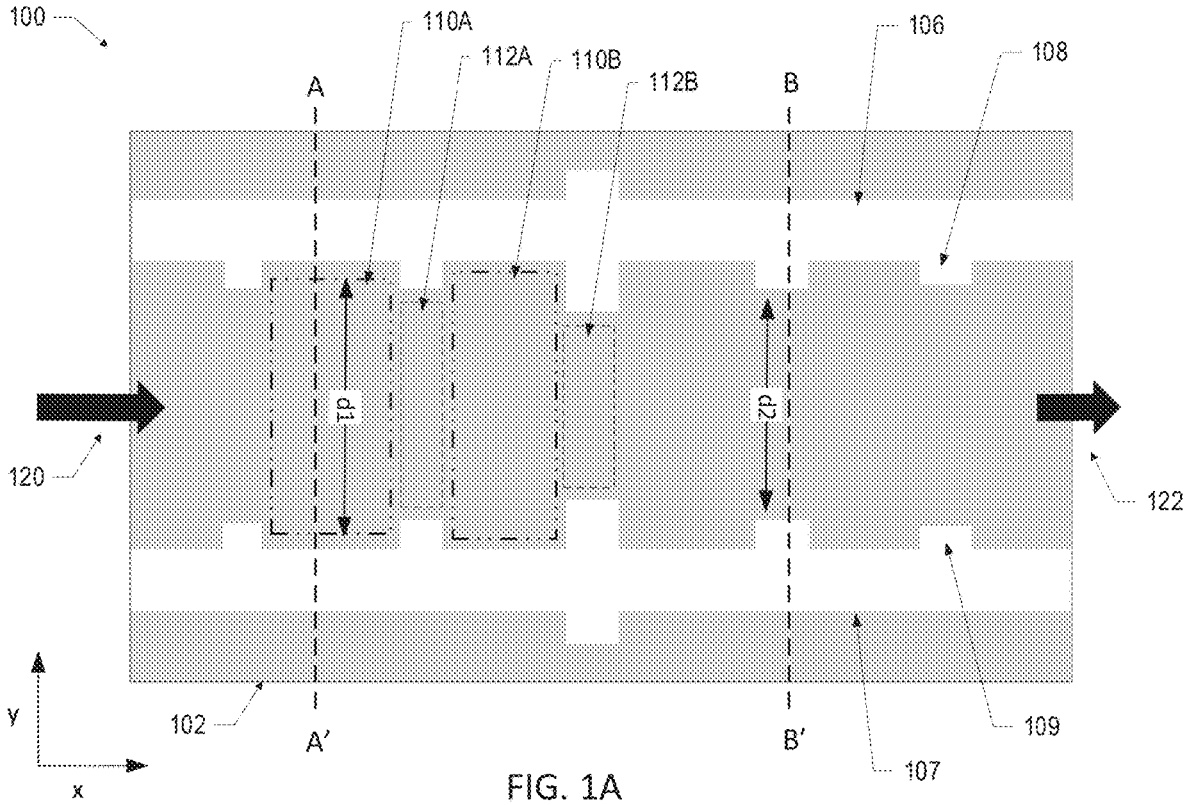
FIG. 1A is a top view of an example SIW filter without the top conductive layer, in accordance with various embodiments.

Microelectronic assemblies that include a lithographically-defined SIW, and related devices and methods, are disclosed herein. For example, in some embodiments, a microelectronic assembly may include a package substrate portion having a first face and an opposing second face; and an SIW component that may include a first conductive layer on the first face of the package substrate portion, a dielectric layer on the first conductive layer, a second conductive layer on the dielectric layer, and a plurality of conductive sidewalls in the dielectric layer, wherein the plurality of conductive sidewalls are continuous structures. In some embodiments, a microelectronic assembly may include a package substrate portion having a first face and an opposing second face; and an SIW filter that may include a first conductive layer on the first face of the package substrate portion, a dielectric layer on the first conductive layer, a second conductive layer on the dielectric layer, a first conductive sidewall and an opposing a second conductive sidewall in the dielectric layer, wherein the first and second conductive sidewalls are continuous structures, and a plurality of resonator cavities in the dielectric layer between the first and second conductive sidewalls.

As more devices become interconnected and users consume more data, the demand on high speed interconnects has grown at an incredible rate. These demands include increased data rates which demand central processing units (CPUs) to transfer high speed signals. One way to achieve high bandwidth (BW) is through frequency-division multiplexing (FDM). FDM is a technique by which the total bandwidth available in a communication medium is divided into a series of non-overlapping frequency bands, each of which is used to carry a separate signal. This allows a single transmission medium to be shared by multiple independent signals. A waveguide filter is a structure that filters a signal to a particular frequency or frequency band. As used herein, "frequency" and "frequency band" may be used interchangeably. A waveguide filter that filters signals at high frequencies (e.g., equal to or greater than 100 GHz), such as radio frequency (RF) and Millimeter Wave/Terahertz (mmWave/THz), may enable increased BW. The SIW components disclosed herein may be formed using lithography to create continuous sidewalls as well as other continuous, non-cylindrical structures. An SIW component having continuous sidewalls and filtering structures may improve guided wave propagation by reducing field leakage and transmission loss as well as increasing the range of supported signal frequencies to 100 GHz or greater.

A waveguide may refer to any linear structure that conveys electromagnetic waves between its endpoints. For example, a waveguide may refer to a rectangular metal tube inside which an electromagnetic wave may be transmitted. A waveguide typically has a rectangular block, or cuboidal, shape with two substantially parallel horizontal sides extending in the x-y directions and two substantially parallel vertical walls extending in the x-z directions. The waveguide may be filled with a dielectric material or may be filled with air. Examples of different types of waveguide-based components include power combiners, power dividers, waveguide filters, directional couplers, diplexers, and multiplexers, among others. Waveguides may be integrated into substrates of electronic devices using lithographic processes, such that the vertical walls of the structure are continuous and/or substantially planar.

A waveguide filter is an electronic filter that is constructed with waveguide technology to form resonator cavities within a waveguide, which allow signals at some frequencies to pass (the passband) and signals at other frequencies to be rejected (the stopband). Examples of different types of waveguide filters include iris-coupled resonator cavity filters, slot-coupled resonator cavity filters, ridge waveguide filters, loaded waveguide filters (reactive loading, capacitive loading, resonant loading) and slot-coupled resonators, among others. A waveguide filter may include a series of coupled resonator cavities, or spaced sections, arranged within the waveguide. Waveguide filter types may be differentiated by the means of coupling the connecting cross-sections. For example, the means of coupling may include apertures, irises, and slots. An electromagnetic wave of a select frequency may propagate longitudinally from one end of the waveguide filter through the coupled resonator cavities to the other end. The select frequency may be defined based on, for example, the dimensions of the resonator cavities, the dimensions of the connecting cross-sections or irises, the length of the waveguide in the longitudinal direction, and the dielectric constant of the waveguide material, among others. The design of a waveguide filter, including the filter type and the dimensions, may be based on the passband width, or fractional BW, with respect to the center frequency of operation, the insertion loss and signal reflection in the passband, the rejection or attenuation at the stopband, or the roll-off between the passband and the stopband, among others.

Conventional metallic waveguide filters may be manufactured separately and mounted to a surface of a circuit board. Conventional SIWs mimic the performance of conventional metallic waveguides but are integrated with a circuit board during manufacturing. Conventional SIWs may formed using two metallization layers, separated by a dielectric layer with two rows of vias forming the opposing sidewalls. The row of metalized through-plated vias emulate a sidewall. The row of metalized vias may have spaces between the vias or the vias may be connected, such that the vias are in contact with the neighboring vias. Conventional SIWs are limited by standard substrate manufacturing techniques where a plurality of mechanically- or laser-drilled, side-by-side, connecting vias form the waveguide wall and the resonant cavities. The vias are typically following large design rules and create non-continuous structures, which may cause signal leakage and increased transmission losses for frequency of operation beyond 100 GHz. As vias are traditionally formed using a laser drilling process, the size and shape of the via is limited to the size and shape of the laser or cylindrical. As such, the row of circular vias, whether spaced apart or in contact, form a discontinuous structure having non-planar vertical sides, which is more likely to lead to increased signal leakage, transmission losses, and signal coupling to neighboring SIWs and/or channels. Moreover, the decreased positioning accuracy of a laser drilling process compared to a lithographic process, leads to increased tolerances among different fabrication lots. Sorting and in-line testing of such components may be needed to verify accurate performance, which may lead to increased costs and low yield. Further, the large design rule requirements of the laser drilling process may limit high-performance waveguide structures to operate at RF/mm-Wave frequencies of 100 GHz or lower.

The use of lithographic processes allows for all conductive structures on a layer to be formed at once (i.e., a single exposure and patterning) instead of being formed sequentially such as when a laser drilling process is used. Further, the use of lithography-based processes to form the SIW allows for the conductive structures to be formed in any desired shape. Instead of being limited to the shape of the laser, a lithographically-defined via may be customized. For example, whereas a laser-defined via may be limited to a circular shape, a lithographically-defined via may be rectangular in shape and may extend in lateral direction to form a continuous sidewall. In another example, a lithographically-defined via may be a vertical post having a non-circular cross-section, such as oval, triangular, or rectangular.

In the following detailed description, reference is made to the accompanying drawings that form a part hereof wherein like numerals designate like parts throughout, and in which is shown, by way of illustration, embodiments that may be practiced. It is to be understood that other embodiments may be utilized and structural or logical changes may be made without departing from the scope of the present disclosure. Therefore, the following detailed description is not to be taken in a limiting sense.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order from the described embodiment. Various additional operations may be performed, and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B, and C). The drawings are not necessarily to scale. Although many of the drawings illustrate rectilinear structures with flat walls and right-angle corners, this is simply for ease of illustration, and actual devices made using these techniques will exhibit rounded corners, surface roughness, and other features.

The description uses the phrases "in an embodiment" or "in embodiments," which may each refer to one or more of the same or different embodiments. Furthermore, the terms "comprising," "including," "having," and the like, as used with respect to embodiments of the present disclosure, are synonymous. As used herein, a "package" and an "IC package" are synonymous, as are a "die" and an "IC die." The terms "top" and "bottom" may be used herein to explain various features of the drawings, but these terms are simply for ease of discussion, and do not imply a desired or required orientation. As used herein, the term "insulating" may mean "electrically insulating," unless otherwise specified.

When used to describe a range of dimensions, the phrase "between X and V" represents a range that includes X and Y. For convenience, the phrase "FIG. 3" may be used to refer to the collection of drawings of FIGS. 3A-3G, the phrase "FIG. 4" may be used to refer to the collection of drawings of FIGS. 4A-4C, etc. Although certain elements may be referred to in the singular herein, such elements may include multiple sub-elements. For example, "an insulating material" may include one or more insulating materials.

FIG. 1A is a top view of an example coupled resonator cavity SIW filter 100 without the top conductive layer, in accordance with various embodiments. The SIW filter 100 may include a first or bottom conductive layer 102, a second or top conductive layer (not shown), a dielectric layer 104 between the first and second conductive layers, a first conductive sidewall 106, and a second conductive sidewall 107. The first and second conductive layers may be substantially parallel and may extend horizontally in the x-y direction. The first and second conductive sidewalls 106, 107 may be substantially parallel and may extend vertically in the x-z direction. The first and second conductive sidewalls 106, 107 may be continuous structures having vertical sides that are planar. The first and second conductive sidewalls 106, 107 may extend through the dielectric layer to connect or be in contact with the first and second conductive layers. The first and second conductive sidewalls 106, 107 may include one or more regions having an enlarged width 108, 109, also referred herein as a ridge". The SIW filter 100 includes five ridges 108, 109 on each of the first and second sidewalls, which have an alternating pattern of enlarged and narrowed widths. These ridges 108, 109 form a series of six resonant cavities (e.g., 110A, 110B) connected by five coupling irises (e.g., 112A, 112B). Although FIG. 1A illustrates six resonant cavities, the SIW filter 100 may have any suitable number of resonant cavities, including more or less than six.

An electromagnetic wave signal may enter at a first end 120 of the SIW, may propagate through the series of coupled resonant cavities 110 and coupling irises 112, and may exit at a second end 122 at a specific frequency. For example, an electromagnetic wave signal may enter by a signal feeding mechanism (not shown), such as a microstrip-to-SIW transition or a microstrip-to-slot transition where the slot may be on the top or bottom conductive layers. Examples of input and output feeds include a microstrip-to-SIW transition, a microstrip-to-slot transition, a stripline-to-SIW transition, a waveguide launcher structure, an RF connector, or an electromagnetic radiating structure, such as an antenna. Although FIG. 1A shows a signal entering at a first end, in some embodiments, the signal path may be reversed such that the electromagnetic wave signal may enter at the second end 122 and exit at the first end 120 at the specific frequency. In some embodiments, an electromagnetic wave signal entering the SIW filter may have any suitable frequency. In some embodiments, an electromagnetic wave signal entering the SIW filter may have a frequency of equal to or greater than 100 GHz. In some embodiments, an electromagnetic wave signal entering the SIW filter may have a frequency of equal to or greater than 150 GHz.

Figure 1B:
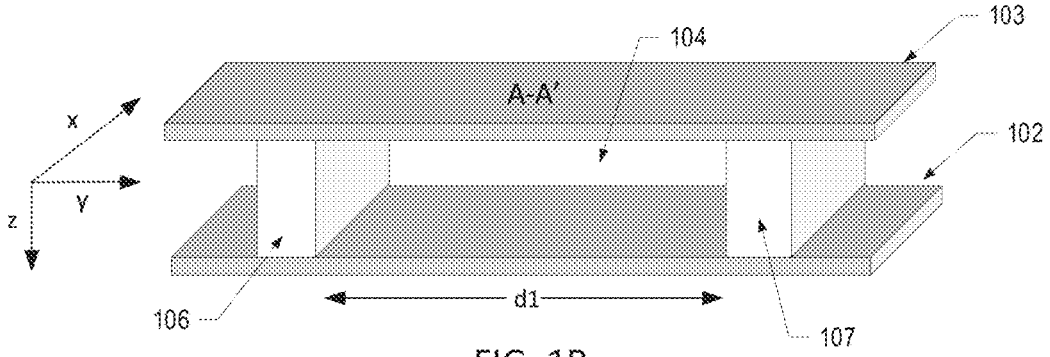
FIGS. 1B-1C are side, cross-sectional views along the A-A' and B-B' lines of the example SIW filter of FIG. 1A with the top conductive layer, in accordance with various embodiments.

The resonant cavities 110 may have any suitable size and shape. As shown in FIG. 1, the resonant cavity along the A-A' cross-section may have a width (y-direction) of d1 and the coupling iris along the B-B' cross-section may have a width of d2, where the d2 width is smaller than the d1 width. In some embodiments, a resonant cavity may have a width (y-direction) between 100 microns (um) and 1000 um, and a length (x-direction) between 100 um and 1000 um. In some embodiments, at least one resonant cavity may have different dimensions than another resonant cavity. In some embodiments, at least one resonant cavity may have the same dimensions as another resonant cavity. In some embodiments, the resonant cavities may have the same dimensions. In some embodiments, each resonant cavity may have different dimensions.

FIG. 16 is a side, cross-sectional view along the A-A' line of the SIW filter 100 of FIG. 1A including the top conductive layer, in accordance with various embodiments. The SIW filter 100 may include a dielectric layer 104 between a first conductive layer 102 and a second conductive layer 103, a first conductive sidewall 106, and a second conductive sidewall 107. The first and second conductive layers 102, 103 may be any suitable size and shape, and may be made of any suitable conductive material. For example, the first and second conductive layers 102, 103 may be a rectangular or a square plane (e.g., cuboidal) having a thickness that is equal to a thickness of a conductive layer of the package substrate, and may be made from a metal, such as copper. In some embodiments, the first and second conductive layers 102, 103 may have a length (x-direction) between 0.5 mm to 50 mm and a width (y-direction) between 100 um and 50 mm. In some embodiments, the first and second conductive layers 102, 103 may have a length (x-direction) between 0.5 mm to 15 mm and a width (y-direction) between 100 um and 15 mm. In some embodiments, the first and second conductive layers 102, 103 may have a thickness (z-direction) between 5 um and 50 um. In some embodiments, the first and second conductive layers 102, 103 may have a thickness between 10 um and 20 um.

The dielectric layer 104 may be made of any suitable material and may include a single layer or may include multiple layers. In some embodiments, the dielectric layer 104 may be an insulating material of the package substrate, such as an organic dielectric material, a fire retardant grade 4 material (FR-4), bismaleimide triazine (BT) resin, polyimide materials, glass reinforced epoxy matrix materials, ceramic-doped materials, or low-k and ultra low-k dielectric (e.g., carbon-doped dielectrics, fluorine-doped dielectrics, porous dielectrics, and organic polymeric dielectrics).

The first and second conductive sidewalls 106, 107 may extend through the dielectric layer to contact the first and second conductive layers 102, 103 and may have a thickness equal to a thickness of the dielectric layer 104. The first and second conductive sidewalls 106, 107 may be continuous structures having planar vertical sides. As used herein, the term "continuous" refers to a structure that has the same form throughout, such that even if multiple structures were attached together in repeating units, the multiple structures would appear as a single uniform structure. In some embodiments, the first and second conductive sidewalls 106, 107 may be substantially parallel. In some embodiments, the first and second conductive sidewalls 106, 107 may have vertical sides that are angled (e.g., v-shaped) rather than parallel. The first and second conductive sidewalls may be separated by a distance of d1, which may equal the width (y-direction) of the resonant cavity along the A-A' cross-section. In some embodiments, a resonant cavity may have length (x-direction) of between 100 um and 1000 um. The first and second conductive sidewalls 106, 107 may be any suitable size and shape, and made from any suitable conductive material. In some embodiments, the first and second conductive sidewalls 106, 107 may have vertical sides that are angled (e.g., v-shaped) rather than parallel. For example, the first and second conductive sidewalls 106, 107 may be cuboidal or trapezoidal, may have the same longitudinal dimension (x-direction) as the first and second conductive layers 102, 103, and may be made of a metal, such as copper. The first and second conductive sidewalls 106, 107 may have a length (x-direction) equal to a length of a first or second conductive layer 102, 103, and a width (y-direction) ranging between 5 um and 500 um.

Figure 1C:
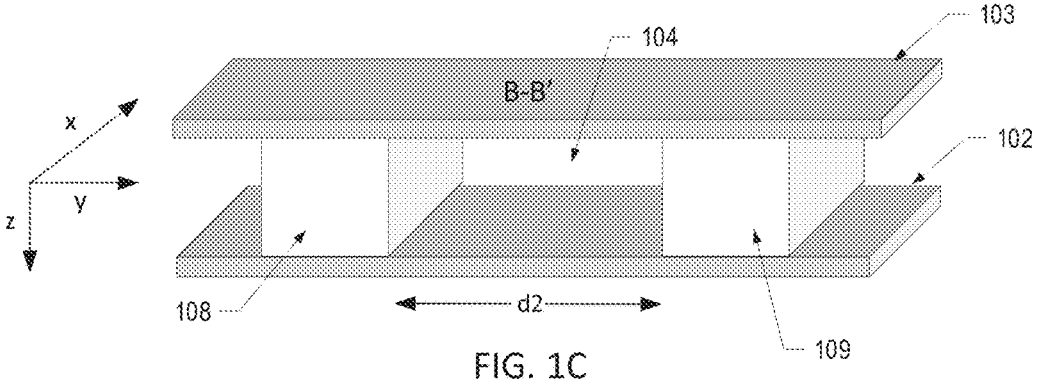

FIG. 1C is a side, cross-sectional view along the B-B' line of the SIW filter 100 of FIG. 1A including the top conductive layer, in accordance with various embodiments. The SIW filter 100 cross-section B-B' may include a dielectric layer 104 between a first conductive layer 102 and a second conductive layer 103, a first conductive ridge 108, and a second conductive ridge 109. The first and second conductive ridges 108, 109 may be separated by a distance of d2, which may equal the width (y-direction) of the coupling iris along the B-B' cross-section. The coupling irises 112 may have any suitable size and shape, which may depend on the desired signal frequency. In some embodiments, the coupling irises 112 may have a width (y-direction) between 50 um and 950 um. In some embodiments, one or more of the coupling irises 112 may have the same width. In some embodiments, the coupling irises may have different widths. In some embodiments, at least two of the coupling irises 112 have the same width. In some embodiments, the coupling irises 112 may have a length (x-direction) between 2 um and 200 um. In some embodiments the coupling irises 112 may have a length (x-direction) between 10 um and 25 um. In some embodiments, the coupling irises 112 may have the same lengths. In some embodiments, the coupling irises may have different lengths. In some embodiments, at least two of the coupling irises 112 may have the same length. The first and second conductive ridges 108, 109 may be any suitable size and shape, and may be made of any suitable conductive material. For example, the first and second conductive ridges 108, 109 may have a rectangular, trapezoidal, triangular or a square shape (e.g., cuboidal), and may be made from a metal, such as copper. The first and second conductive ridges 108, 109 may have a length (x-direction) between 2 um and 200 um. In some embodiments, the ridge may have a length (x-direction) between 10 um and 25 um.

A package substrate may include more than one SIW filter for filtering electromagnetic signals at multiple frequencies. For example, in an embodiment where a package substrate has three SIW filters for filtering at three different frequencies, the SIW filters may be three separate structures on the same, or on different, package substrate layers. In another embodiment, the three separate SIW filters may be coupled via a slot or an iris, as described in more detail below with reference to FIG. 5. In another embodiment, the three SIW filters may be integrated into a single structure. An SIW filter may be connected to additional components. For example, an input and output feed may be attached to either end of an SIW filter to couple the SIW filter to mmWave or RF frequencies. Examples of input and output feeds include a microstrip-to-SIW transition, a microstrip-to-slot transition, a stripline-to-SIW transition, a waveguide launcher structure, an RF connector, or an electromagnetic radiating structure, such as an antenna.

Figure 2B:
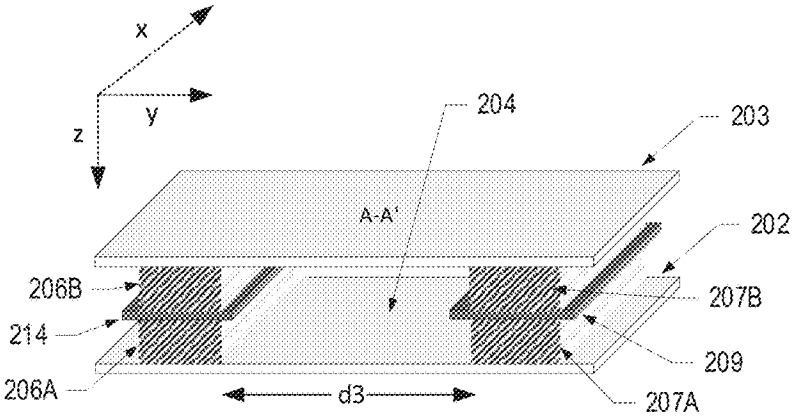
FIGS. 2B-2C are side, cross-sectional views along the A-A' and B-B' lines of the example SIW filter of FIG. 2A with the top conductive layer, in accordance with various embodiments.
Figure 2C:
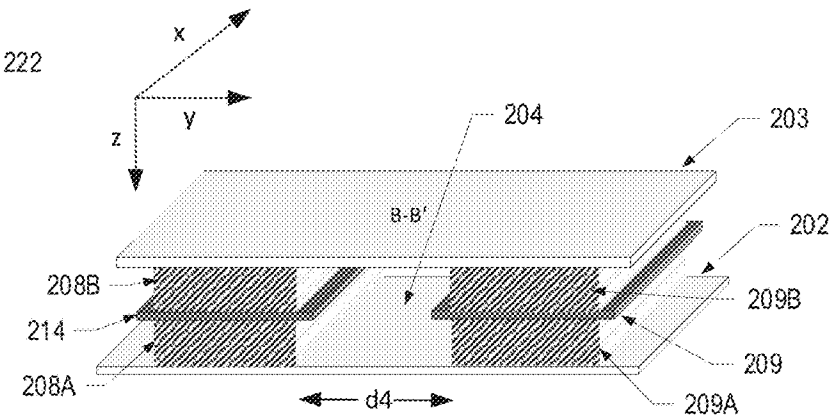
Figure 2A:
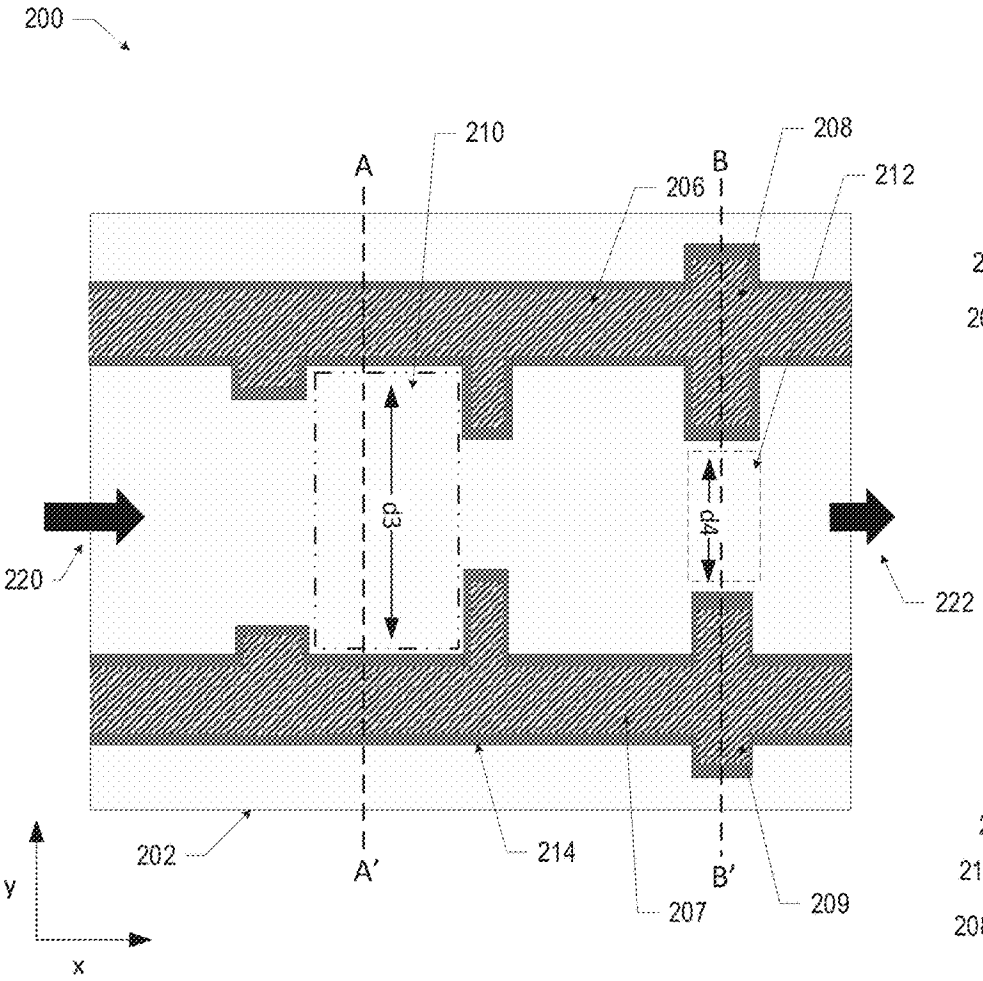
FIG. 2A is a top view of an example SIW filter without the top conductive layer, in accordance with various embodiments.

FIG. 2A is a top view of an example SIW filter 200 without the top conductive layer, in accordance with various embodiments. The SIW filter 200 may include a first or bottom conductive layer 202, a second or top conductive layer (not shown), a dielectric layer between the first and second conductive layers (not shown), a first multilayer conductive sidewall 206 and a second multilayer conductive sidewall 207 in the dielectric layer, and a third conductive layer 214 between the first and second conductive layers 202, 203. The third conductive layer 214 may be a trace layer having contacts pads that couple the multiple layers of the first and second conductive sidewalls 206, 207. The first and second multilayer conductive sidewalls 206, 207 may include one or more regions having a ridge 208, 209. The SIW filter 200 includes three ridges 208, 209 on each of the first and second sidewalls, which may have an alternating pattern of enlarged and narrowed widths. These ridges 208, 209 form a series of four resonant cavities 210 connected by three coupling irises 212. In some embodiments, an electromagnetic wave signal may enter from a first end 220 of the SIW, may propagate through the series of coupled resonant cavities 210 and coupling irises 212, and exit at a second end 222 at a specific frequency. In some embodiments, the signal path may be reversed where an electromagnetic wave signal may enter from the second end 222 of the SIW, may propagate through the series of coupled resonant cavities 210 and coupling irises 212, and may exit at the first end 220 at a specific frequency. As described above with reference to FIG. 1, the resonant cavities 210 and the coupling irises 212 may have any suitable size, shape, and patterning, and may have a thickness of multiple layers. As shown in FIG. 2, the resonant cavity along the A-A' cross-section may have a width (y-direction) of d3 and the iris along the B-B' cross-section may have a width of d4, where the d4 width is smaller than the d3 width. The first and second conductive layers 202, 203 and dielectric layer 204 may have any suitable size and shape and may be made of any suitable material, as described above with reference to FIG. 1.

FIG. 2B is a side, cross-sectional view along the A-A' line of the SIW filter 200 of FIG. 2A including the top conductive layer, in accordance with various embodiments. The SIW filter 200 may include a dielectric layer 204 between a first conductive layer 202 and a second conductive layer 203, a first multilayer conductive sidewall 206, a second multilayer conductive sidewall 207, and a third conductive layer 214 between the first and second conductive layers. The dielectric layer 204 may include multiple layers and, as shown in FIG. 2B, may have a thickness of approximately three package substrate layers (e.g., a first dielectric layer, a metal layer, and a second dielectric layer).

The first and second conductive sidewalls 206, 207 may span more than one dielectric layers and have a thickness (z-direction) of greater than a single dielectric layer. In some embodiments, the first and second conductive sidewalls may span two or more conductive layers. As shown in FIG. 2B, the first and second multilayer conductive sidewalls 206, 207 may have a thickness (z-direction) that includes three package substrate layers, including a thickness of two dielectric layers 206A/206B and 207A/207B and a thickness of a third conductive layer 214. The multiple layers of the first and second conductive sidewalls 206, 207 may be continuous structures having substantially planar sides with a contact pad, formed on the third conductive layer 214, between the multiple layers. As shown in FIG. 2, the contact pad may have a larger footprint (e.g., xy dimension) than the first and second conductive sidewalls 206, 207. In some embodiments, the contact pad may have a footprint that may overlap the footprint of the first and second conductive sidewalls 206, 207 by between 1 um and 10 um on each side. In some embodiments, the contact pad may have a footprint that may overlap the footprint of the first and second conductive sidewalls 206, 207 by between 3 um and 8 um on each side. In some embodiments, the contact pad may have a footprint that equals footprint of the first and second conductive sidewalls 206, 207 such that there is no overlap. In some embodiments, the first and second conductive sidewalls 206, 207 may be opposing, substantially parallel, vertical walls. The first and second conductive sidewalls 206, 207 may be separated by a distance of d3, the width (y-direction) of the resonant cavity along the A-A' cross-section. The first and second conductive sidewalls 106, 107 may be any suitable size and shape, and made from any suitable conductive material as described above with reference to FIG. 1.

FIG. 2C is a side, cross-sectional view along the B-B' line of the SIW filter 200 of FIG. 2A including the top conductive layer, in accordance with various embodiments. The SIW filter 200 may include a dielectric layer 204 between a first conductive layer 202 and a second conductive layer 203, a first multilayer conductive ridge 208, a second multilayer conductive ridge 209, and a third conductive layer 214 between the first and second conductive layers. The dielectric layer 204 may include multiple layers and, as shown in FIG. 2B, may have a thickness of approximately three package substrate layers.

The first and second conductive ridges 208, 209 may be multilayered and may have a thickness (z-direction) of more than a single dielectric layer. As shown in FIG. 2C, the first and second multilayer conductive ridges 208, 209 may have a thickness (z-direction) that includes three package substrate layers, including a thickness of two dielectric layers 208A/208B and 209A/2096 and a thickness of a third conductive layer 214. The multiple layers of the first and second conductive ridges 208, 209 may be continuous structures having substantially planar sides with a contact pad, formed on the third conductive layer 214, between the multiple layers. As shown in FIG. 2, the contact pad on the third conductive layer 214 may have a larger footprint (e.g., xy dimension) than the first and second conductive ridges 208, 209. In some embodiments, the contact pad may have a footprint that may overlap the first and second conductive ridges 208, 209 by between 1 um and 10 um on each side. In some embodiments, the contact pad may have a footprint that may overlap the footprint of the first and second conductive ridges 208, 209 by between 3 um and 8 um on each side. In some embodiments, the contact pad may have a footprint that equals footprint of the first and second conductive ridges 208, 209 such that there is no overlap. The first and second conductive ridges 208, 209 may be separated by a distance of d4, the width (y-direction) of the iris 212 along the B-B' cross-section, where the d4 distance is less than the d3 distance. The first and second conductive sidewalls 206, 207 and the first and second conductive ridges 208, 209 may be any suitable size and shape, and made from any suitable conductive material, as described above with reference to FIG. 1.

Any suitable techniques may be used to manufacture microelectronic assemblies having the SIW filters disclosed herein. For example, FIGS. 3A-3G are side, cross-sectional views of various stages in an example process for manufacturing the SIW filter 100 of FIG. 1, in accordance with various embodiments. Although the operations discussed below with respect to FIGS. 3A-3G are illustrated in a particular order, these operations may be performed in any suitable order. Additionally, although particular assemblies are illustrated in FIGS. 3A-3G, the operations discussed below with reference to FIGS. 3A-3G may be used to form any suitable SIW filters having continuous sidewalls.

Figure 3A:
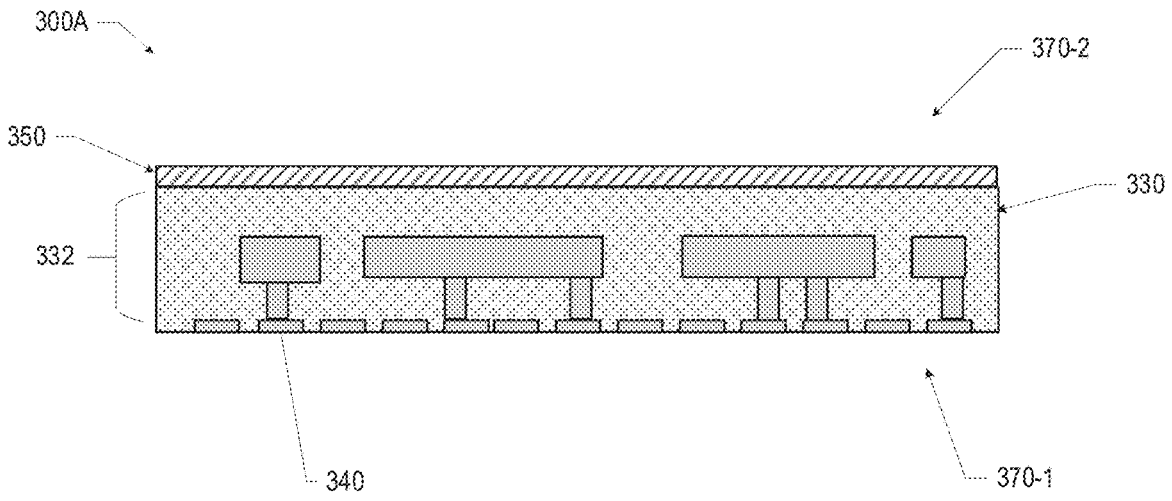
FIGS. 3A-3G are side, cross-sectional views of various stages in an example process for manufacturing a microelectronic assembly having the SIW filter of FIG. 1, in accordance with various embodiments.

FIG. 3A illustrates an assembly 300A including a package substrate portion 332. In some embodiments, the package substrate portion 332 may be formed using a lithographically-defined via packaging process. In some embodiments, the package substrate portion 332 may be manufactured using standard PCB manufacturing processes, and thus the package substrate portion 332 may take the form of a PCB. In some embodiments, the package substrate portion 332 may be a set of redistribution layers formed on a panel carrier (not shown) by laminating or spinning on a dielectric material, and creating conductive vias and lines by laser drilling and plating. In some embodiments, the package substrate portion 332 may be formed on a removable carrier (not shown) using any suitable technique, such as a redistribution layer technique. Any method known in the art for fabrication of the package substrate portion 332 may be used, and for the sake of brevity, such methods will not be discussed in further detail herein. The package substrate portion 332 may be the "bottom" portion of the package substrate and may include conductive contacts 340 at the bottom surface 370-1 of the package substrate for attaching to a circuit board. The package substrate portion 332 may be built up to a desired dielectric layer 330 for integrating the SIW filter. A conductive seed layer 350 is deposited over a top surface 370-2 of a dielectric layer 330. In some embodiments, the seed layer 350 may be a copper seed layer.

Figure 3B:
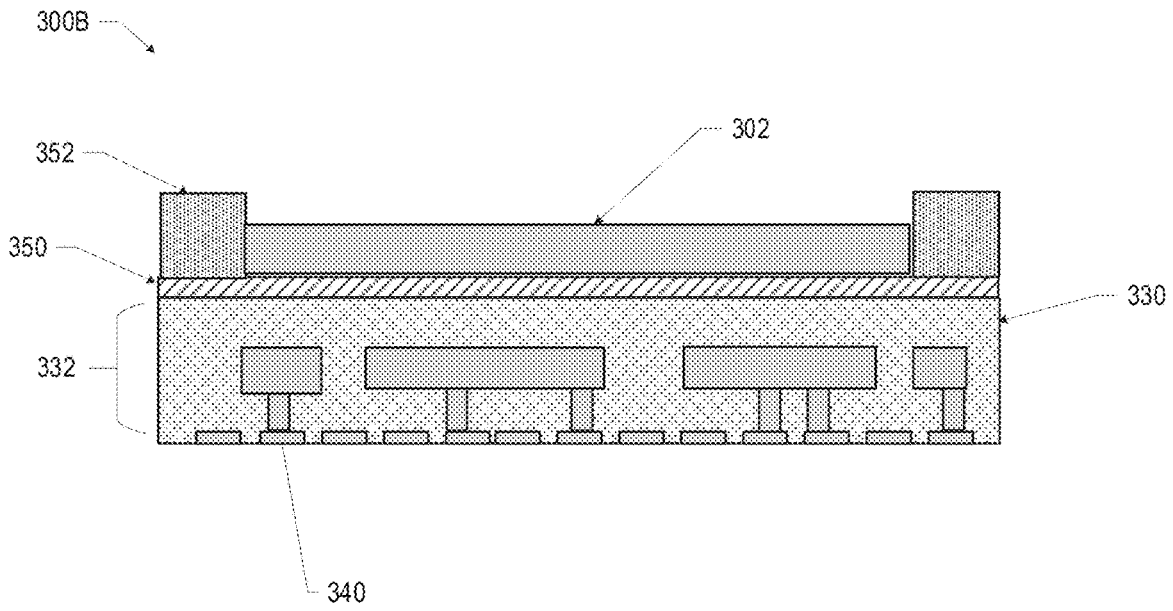

FIG. 3B illustrates an assembly 300B subsequent to forming a photoresist material 352 over the seed layer 350 and patterning the photoresist material 352 to provide openings for the formation of a first conductive layer 302 of the SIW filter. In some embodiments, the photoresist material may be patterned using lithographic processes (e.g., exposed with a radiation source through a mask (not shown) and developed with a developer). After the photoresist material 352 has been patterned, the first conductive layer 302 may be formed. In some embodiments, the first conductive layer 302 may be using an electroplating process or the like. The first conductive layer 302 may be any desired shape.

Figure 3C:
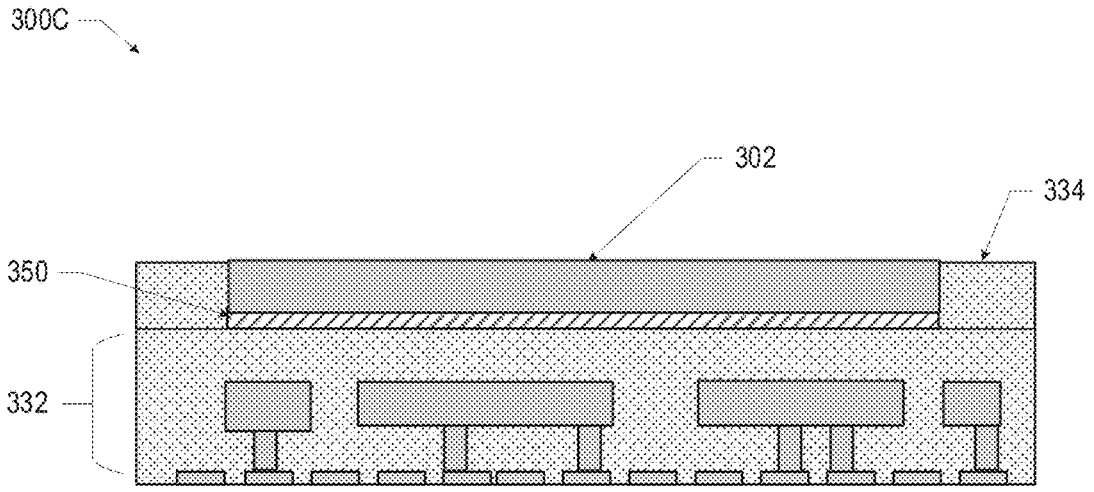

FIG. 3C illustrates an assembly 300C subsequent to stripping the photoresist material 352, removing the remaining portions of the seed layer 350 as shown in FIG. 3B, and forming a first dielectric layer 334 over the first conductive layer 302. In some embodiments, the seed layer 350 may be removed with a seed etching process. The first dielectric layer 334 may be formed using any suitable process, such as lamination or slit coating and curing. In some embodiments, the first dielectric layer 334 may be formed to a thickness that is greater than a thickness of the first conductive layer 302 to ensure uniformity of the layer and cover the top surface of the first conductive layer 302. A controlled etch process may be used to remove dielectric material to expose the top surface of the first conductive layer 302. In some embodiments, the dielectric removal process may include a wet etch, a dry etch (e.g., a plasma etch). a wet blast, or a laser ablation (e.g., by using excimer laser). In some embodiments, the thickness of the first dielectric layer 334 may be minimized to reduce the etching time required to expose the top surface of the first conductive layer 302. In some embodiments, the thickness of the first dielectric layer 334 may be controlled such that the first conductive layer 302 may extend above the top surface of the dielectric layer 334 and the dielectric removal process may be omitted.

Figure 3D:
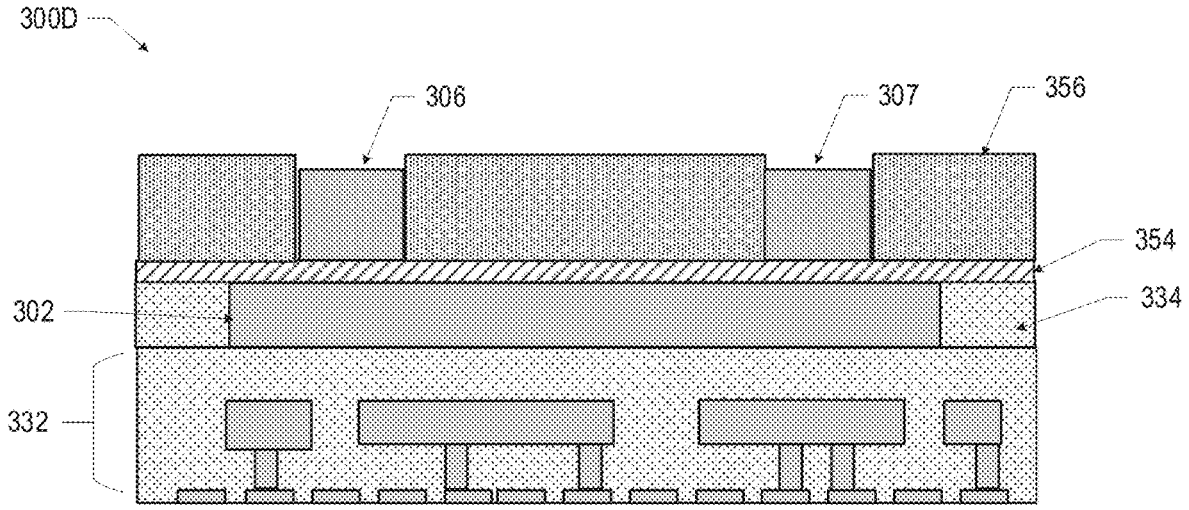

FIG. 3D illustrates an assembly 300D subsequent to forming a second seed layer 354 on the first conductive layer 302 and the first dielectric layer 334, forming a photoresist material 356 over the second seed layer 354, patterning the photoresist material 356 to provide openings for the formation of a first conductive sidewall 306 and second conductive sidewall 307, and depositing conductive material, such as copper, in the openings to form the first and second conductive sidewalls 306, 307. The openings may have any suitable size and shape for forming a conductive structure having the desired characteristics. For example, the first and second conductive sidewalls 306, 307 may have any shape, including a cuboidal via that extends lengthwise (x-direction) to form a continuous sidewall. In some embodiments, the openings may be patterned to have sections with a larger width and sections with a narrower width, such that the first and second conductive sidewalls 306, 307 may include ridges as shown in FIG. 1. The conductive material may be deposited in one layer or may be deposited in more than one layer. Assembly 300D may be formed using the processes described above with reference to FIGS. 3A and 3B.

Figure 3E:
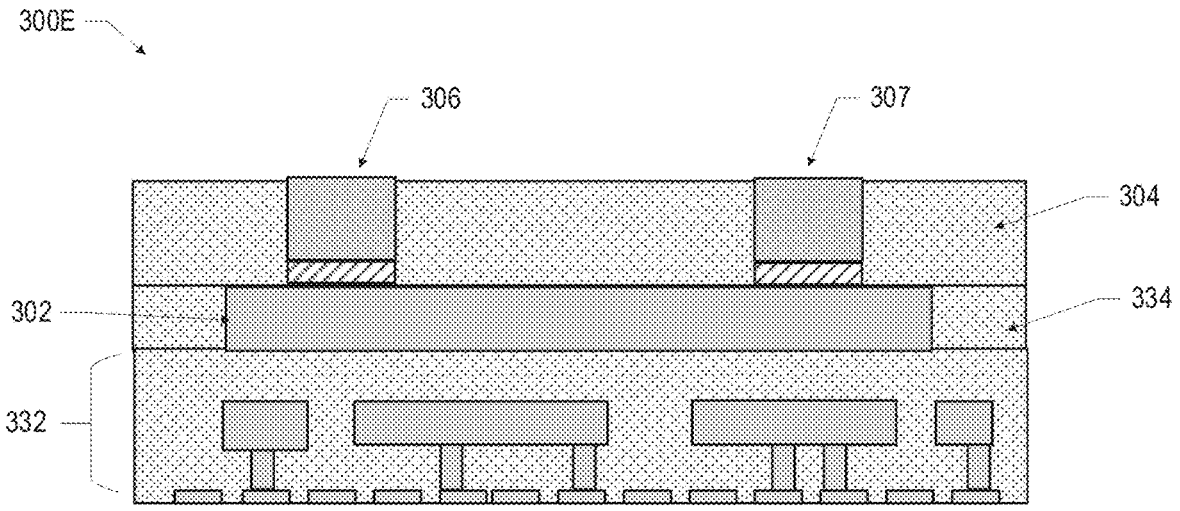

FIG. 3E illustrates an assembly 300E subsequent to stripping the photoresist material 356, removing the remaining portions of the second seed layer 354, and forming a second dielectric layer 304 over the first and second conductive sidewalls 306, 307. Assembly 300E may be formed using the processes described above with reference to FIG. 3C.

Figure 3F:
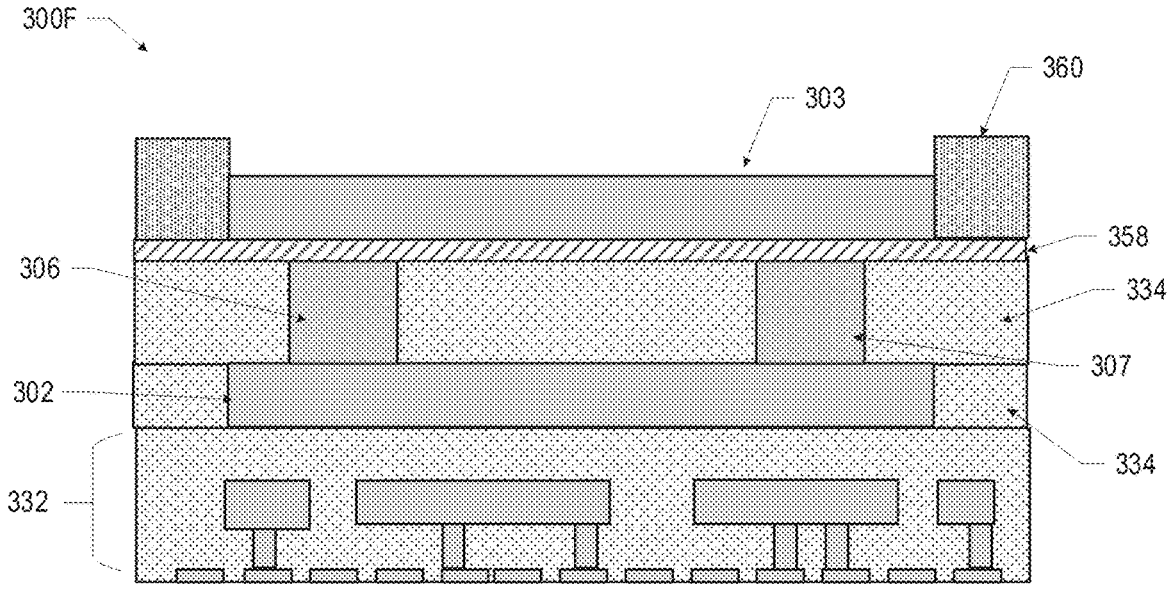

FIG. 3F illustrates an assembly 300F subsequent to forming a third seed layer 358 on the first and second conductive sidewalls 306, 307 and the second dielectric layer 304, forming a photoresist material 360 over the third seed layer 358, patterning the photoresist material 360 to provide an opening for the formation of a second conductive layer 303, and depositing conductive material in the opening to form the second conductive layer 303. Assembly 300F may be formed using the processes described above with reference to FIGS. 3A and 3B.

Figure 3G:
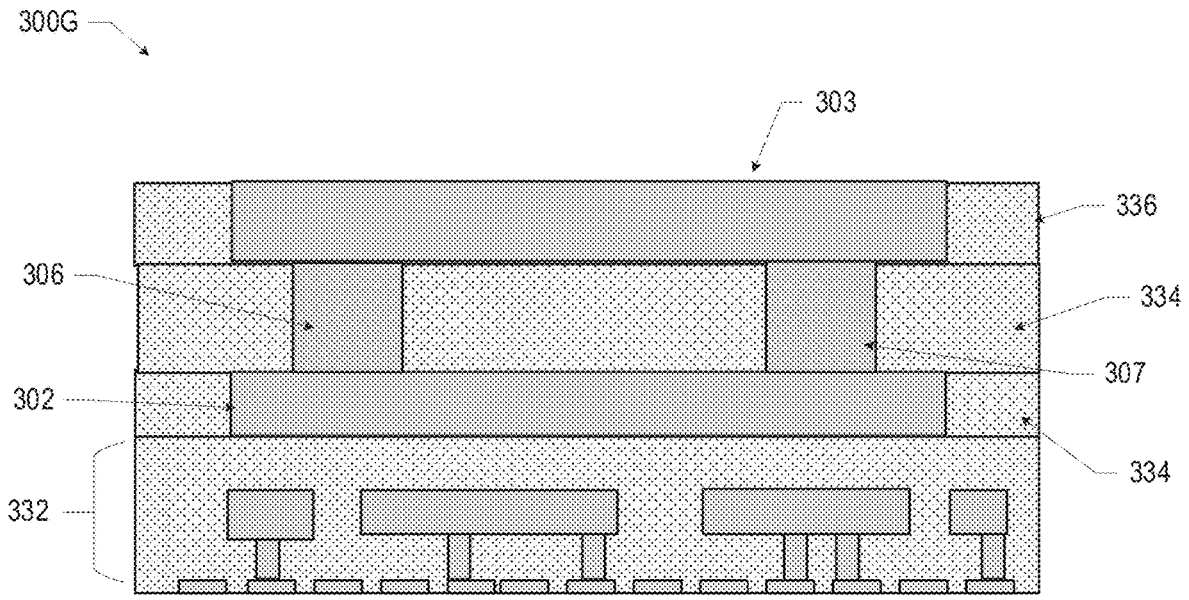

FIG. 3G illustrates an assembly 300G subsequent to stripping the photoresist material 360, removing the remaining portions of the third seed layer 358, and forming a third dielectric layer 336 over the second conductive layer 303. Assembly 300G may be formed using the processes described above with reference to FIG. 3C.

Additional layers may be formed by repeating the process, or part of the process, as described with respect to FIGS. 3A-3H. The finished substrate may be a single package substrate or may be a repeating unit that may undergo a singulation process in which each unit is separated for one another to create a single package substrate. Further operations may be performed as suitable (e.g., attaching dies to the package substrate, attaching solder balls for coupling to a circuit board, etc.).

Figure 4A:
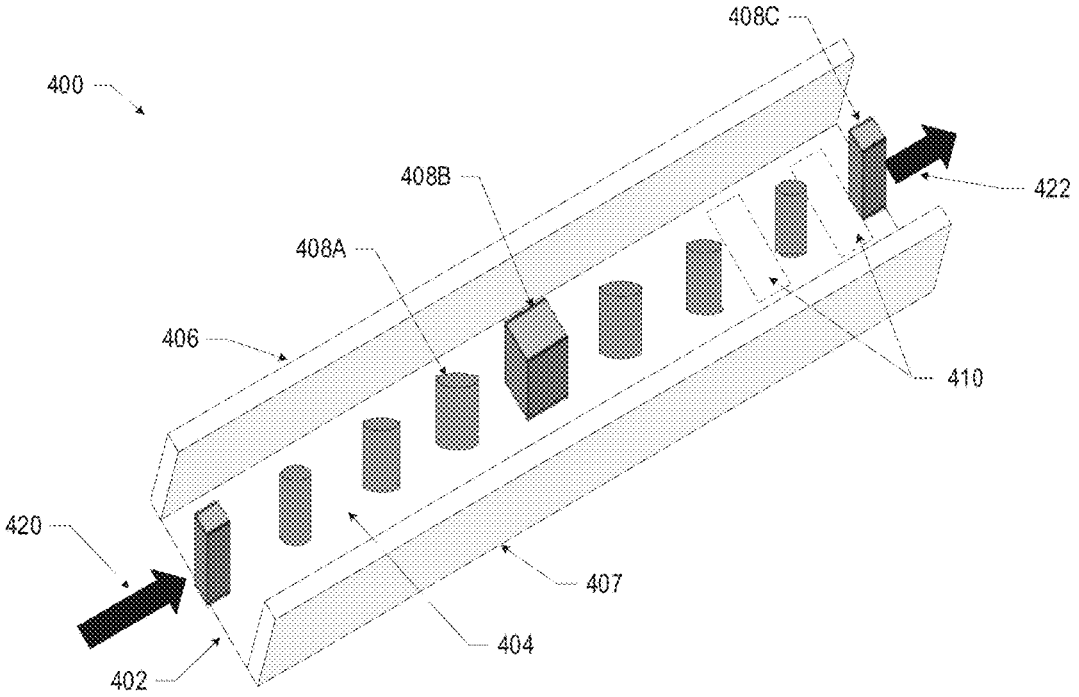
FIG. 4A is a top view of an example SIW filter without the top conductive layer, in accordance with various embodiments.

FIG. 4A is a top/side view of a three-dimensional illustration of an example post loaded resonator SIW filter without the top conductive layer, in accordance with various embodiments. The SIW filter 400 may include a first or bottom conductive layer 402, a second or top conductive layer (not shown), a dielectric layer 404 sandwiched between the first and second conductive layers, a first conductive sidewall 406 and an opposing second conductive sidewall 407, and a plurality of vertical posts 408 in the dielectric layer 404 between the first and second conductive sidewalls 406, 407. The first and second conductive layers may be substantially parallel and may extend horizontally in the x-y direction. The first and second conductive sidewalls 406, 407 may be substantially parallel and may extend vertically in the x-z direction. The first and second conductive sidewalls 406, 407 may be continuous structures having a cuboidal shape with vertical sides that are planar. The first and second conductive sidewalls 406, 407 may extend through the dielectric layer to connect or be in contact with the first and second conductive layers. The plurality of vertical posts 408 may extend through the dielectric layer to connect or be in contact with the first and second conductive layers. The plurality of vertical posts 408 may be arranged in the SIW to form a series of resonant cavities 410, where the resonant cavities are formed between adjacent vertical posts. In some embodiments, an electromagnetic wave signal may enter at a first end 420 of the SIW, may propagate through the series of coupled resonant cavities 410, and exit at a second end 422 at a specific frequency. In some embodiments, a signal path may be reversed where an electromagnetic signal may enter at the second end 422 and exit at the first end 420 at a specific frequency. Although FIG. 4A illustrates eight resonant cavities, the SIW filter 400 may have any suitable number of resonant cavities, including more or less than eight.

Figure 4B:
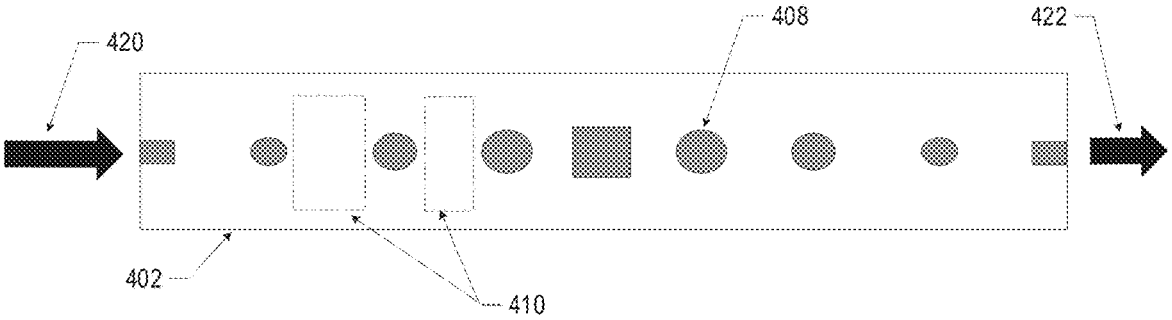
FIG. 4B is a top/side view of a three-dimensional illustration of the SIW filter of FIG. 4A without the top conductive layer, in accordance with various embodiments.

FIG. 4B is a top view of the SIW filter of FIG. 4A without the top conductive layer, in accordance with various embodiments. The plurality of vertical posts 408 may have any suitable size and shape, and may be formed from any suitable conductive material, such as copper. In some embodiments, the plurality of vertical posts 408 may have a non-circular cross-section, such as oval 408A, square 408B, rectangular 408C, crescent-shaped (not shown), or triangular (not shown). In some embodiments, the plurality of vertical posts 408 may have a circular cross-section. In some embodiments, the plurality of vertical posts 408 may have the same dimensions. For example, an individual vertical post 408 may have a cross-section between 10 um and 300 um. In some embodiments, the plurality of vertical posts 408 may have different dimensions. For example, as shown in FIG. 4, the plurality of vertical posts 408 may have different cross-section dimensions where the vertical posts nearest the first end 420 and the second end 422 of the SIW have smaller cross-sectional dimensions compared to the vertical posts nearest the center of the SIW. The plurality of vertical posts 408 may have any suitable arrangement. As shown in FIG. 4B, the plurality of vertical posts 408 may have a linear arrangement with different spacing between adjacent posts (e.g., some with wider spacing and some with narrower spacing). In some embodiments, the plurality of vertical posts 408 may have a non-linear arrangement, such as a serpentine or a zigzag. Although FIG. 4 depicts the plurality of vertical posts 408 having a particular size, shape, number, and arrangement, the plurality of vertical posts may have any suitable size, shape, number, and arrangement.

Figure 4C:
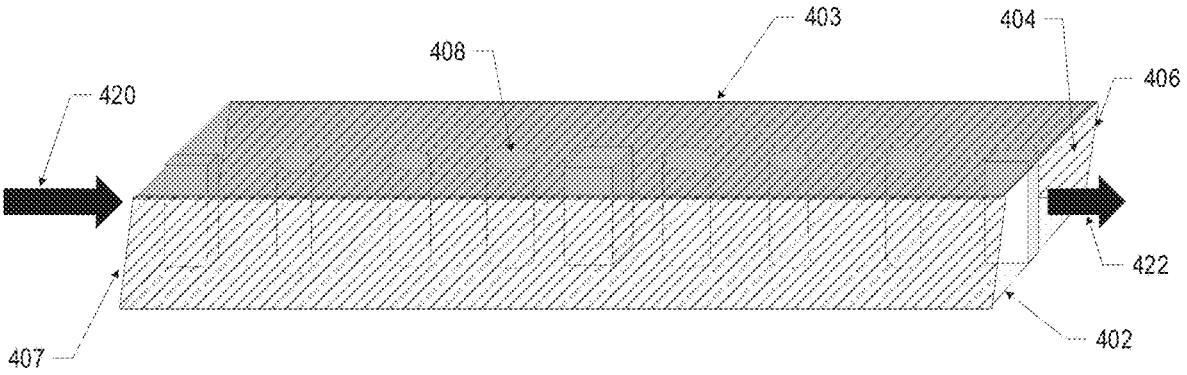
FIG. 4C is a side view of a three-dimensional illustration of the SIW filter of FIG. 4A including the top conductive layer, in accordance with various embodiments.

FIG. 4C is a side view of a three-dimensional illustration of the SIW filter of FIG. 4A including the top conductive layer 403, in accordance with various embodiments. As shown in FIG. 4C, the SIW filter 400 may include a first conductive layer 402, a second conductive layer 403, a dielectric layer 404 sandwiched between the first and second conductive layers 402, 403, a first conductive sidewall 406 and an opposing second conductive sidewall 407, where the first and second sidewalls are continuous with planar vertical sides, and a plurality of vertical posts 408, including individually labeled posts 408A, 408B, and 408C as shown in FIG. 4A, in the dielectric layer 404 between the first and second conductive sidewalls 406, 407.

Figure 5:
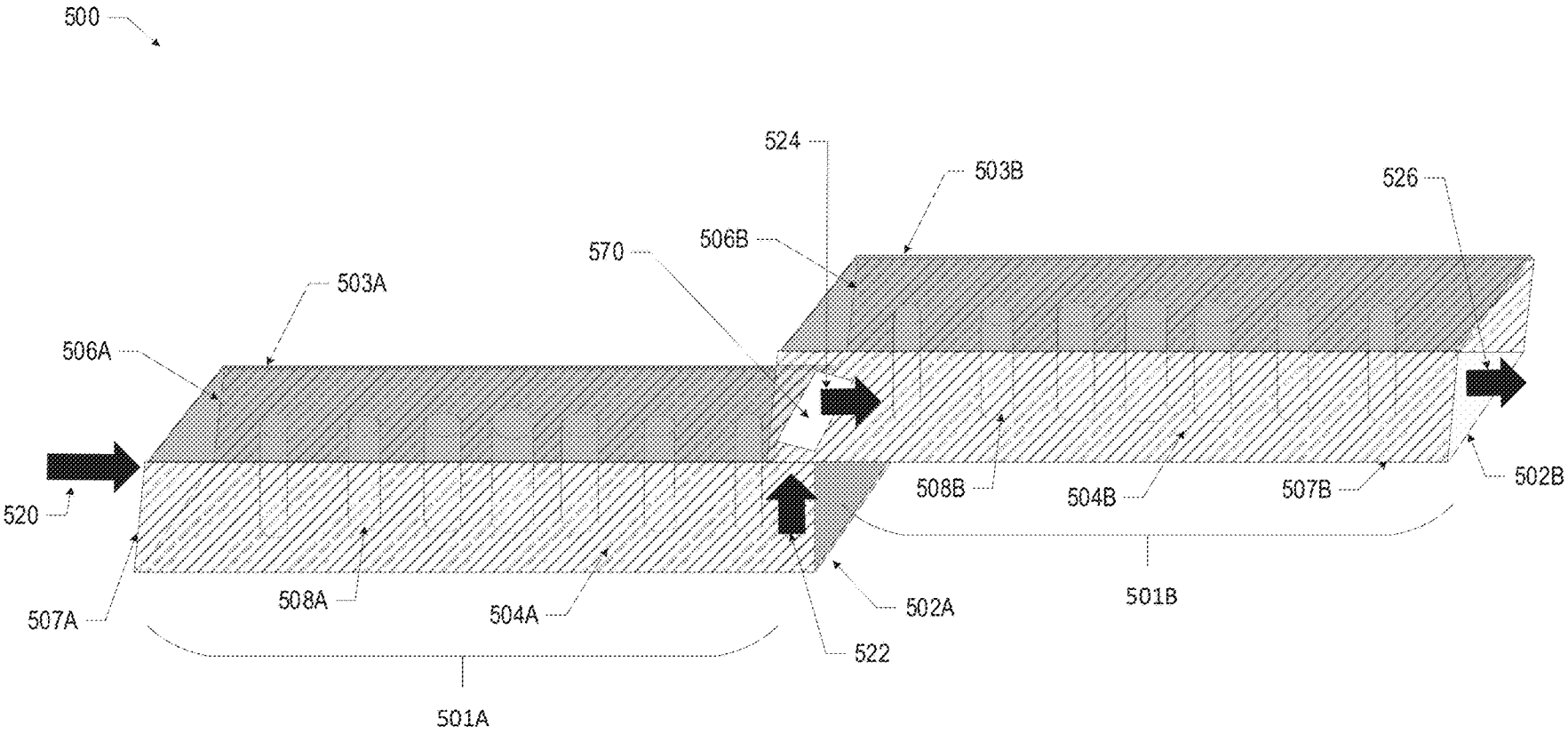
FIG. 5 is a side view of a three-dimensional illustration of two slot-coupled SIW filters, in accordance with various embodiments.

FIG. 5 is a side view of a three-dimensional illustration of a slot-coupled SIW filter, in accordance with various embodiments. The SIW filter 500 may include a first SIW filter 501A and a second SIW filter 501B coupled via a slot, or opening, 570. In some embodiments, the slot may be filled with a dielectric material. The first and second SIW filters 501A, 501B are post loaded resonator filters having a first conductive layer 502, a second conductive layer 503, a dielectric layer 504 sandwiched between the first and second conductive layers 502, 503, a first conductive sidewall 506 and an opposing second conductive sidewall 507, where the first and second sidewalls are continuous structures, and a plurality of vertical posts 508 in the dielectric layer 504 between the first and second conductive sidewalls 506, 507. In some embodiments, the first and second SIW filters 501A, 501B may be connected by a slot such that an electromagnetic wave signal may enter from a first end 520 of the first SIW filter 501A, may propagate through the resonant cavities of the first SIW filter 501A, exit at a second end 522 at a first frequency through the slot 570 to enter the second SIW filter 501B at a first end 524, propagate through the resonant cavities of the second SIW filter 501B, and exit at a second end 526 at a second frequency. In some embodiments, the signal path may be reversed where the signal may enter at the second end 526 of the second SIW filter 501B and exit at the first end 520 of the first SIW filter 501A.

Although FIG. 5 shows two slot-coupled post loaded resonator SIW filters, any number and any type of SIW filters may be used, including coupled resonator cavity filters, or ridge waveguide-based filters. In some embodiments, as shown in FIG. 5, the first and second SIW filters 501A, 5016 may be on different substrate layers. In some embodiments, the slot-coupled SIW filters may be on the same substrate layers. In some embodiments, the slot-coupled SIW filters may be arranged on the same substrate layer end-to-end such that a slot may be placed at the interface where the first SIW filter ends and the second SIW filter starts. In some embodiments, the slot-coupled SIW filters by be arranged on the same substrate layer cascading side-by-side such that a slot may be placed at the interface where a first sidewall near the end of the first SIW filter overlaps with a second sidewall near the start of the second SIW filter. In some embodiments, one or more SIW filters may be coupled using other coupling mechanisms, such as round irises, and may be coupled based on an electrical domain or a magnetic domain. Although FIG. 5 shows a series of SIW filters coupled by a slot, any suitable arrangement may be used to couple SIW components, including, for example, an iris. In some embodiments, one or more SIW components may be coupled by a vertical iris in the sidewalls, or in a common or shared sidewall, of side-by-side SIW components. Moreover, although FIG. 5 shows the first and second conductive sidewalls as having a thickness equal to a single dielectric layer, the first and second conductive sidewalls as well as the plurality of conductive vertical posts may have any suitable thickness and may span two or more dielectric layers of the package substrate.

Figure 6:
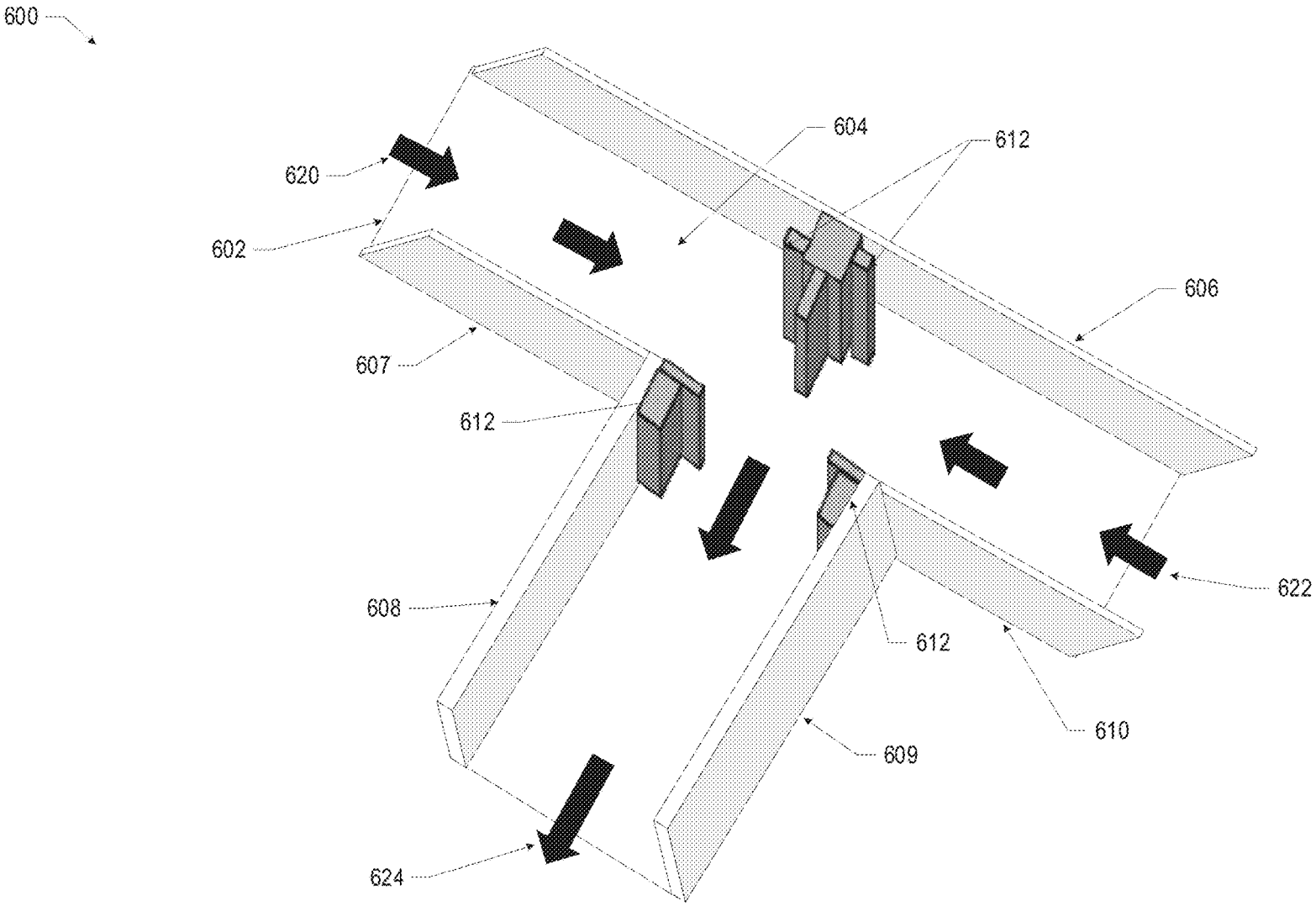
FIG. 6 is a top view of a three-dimensional illustration of an SIW combiner without the top conductive layer, in accordance with various embodiments.

FIG. 6 is a top view of a three-dimensional illustration of an SIW diplexer without the top conductive layer, in accordance with various embodiments. The SIW diplexer 600 may include a first or bottom conductive layer 602, a second or top conductive layer (not shown), a dielectric layer 604 between the first and second conductive layers, a plurality of conductive sidewalls 606-610, and a plurality of conductive structures 612. The first and second conductive layers may be substantially parallel and may extend horizontally in the x-y direction. The plurality of conductive sidewalls 606-610 may extend vertically in the x-z direction. The plurality of conductive sidewalls 606-610 may be arranged to form three channels or ports, including a first port 620, a second port 622, and a third port 624 for the transmission of an electromagnetic wave signal. The plurality of conductive sidewalls 606-610 may be continuous structures having vertical sides that are planar. The plurality of conductive sidewalls 606-610 may extend through the dielectric layer 604 to connect or be in contact with the first and second conductive layers. The plurality of conductive structures 612 may have any suitable size, shape, number, and arrangement for dividing an electromagnetic signal into one or more frequency bands. For example, as shown in FIG. 6, the plurality of conductive structures 612 may be arranged to split or divide an electromagnetic wave signal into two different frequency bands. In some embodiments, as shown in FIG. 6, the plurality of conductive structures 612 may include vertical posts. In some embodiments, the plurality of conductive structures 612 may include ridges and/or fins. In some embodiments, the plurality of conductive structures 612 may form filters for filtering a signal to a specific frequency. As shown in FIG. 6, an SIW component may act as a combiner where a first part of an electromagnetic wave signal (e.g., a high frequency band) may enter at the first port 620 and a second part of an electromagnetic wave signal (e.g., a low frequency band) may enter at the second port 622, the first and second electromagnetic wave signals may propagate through the plurality of conductive structures 612 and combine to exit at the third port 624.

Although FIG. 6 shows an electromagnetic wave signal combiner, in some embodiments, the signal path may be reversed such that the SIW component may act as a signal separator or divider. In some embodiments, the plurality of conductive structures 612 may be arranged to split or divide the power of an electromagnetic wave signal into one frequency band. In some embodiments, the plurality of conductive structures 612 may be arranged to split or divide an electromagnetic wave signal into two or more frequency bands. For example, an electromagnetic wave signal may enter at the third port 624, may propagate through the plurality of conductive structures 612, which may divide the signal into two frequency bands (e.g., a high frequency band and low frequency band) or may divide the power of the signal into two parts of the same frequency band, such that a first part of the signal exits at the first port 620 and a second part of the signal exits at the second port 622. Although FIG. 6 shows the plurality of conductive sidewalls as having a thickness equal to a single dielectric layer, the plurality of conductive sidewalls as well as the plurality of conductive structures may have any suitable thickness and may span two or more dielectric layers of the package substrate.

Figure 7:
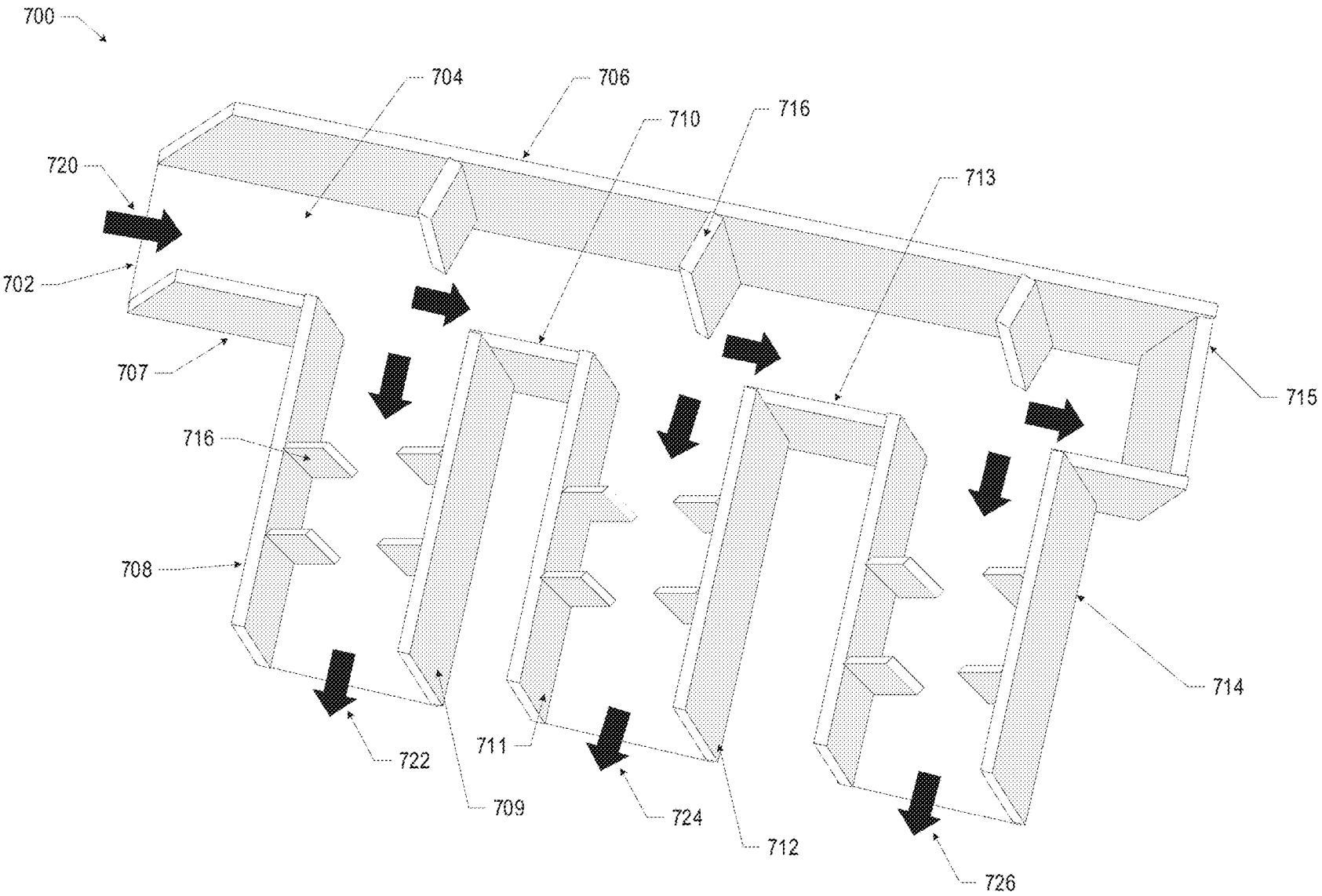
FIG. 7 is a top view of a three-dimensional illustration of an SIW triplexer without the top conductive layer, in accordance with various embodiments.

FIG. 7 is a top view of a three-dimensional illustration of an SIW triplexer without the top conductive layer, in accordance with various embodiments. The SIW triplexer 700 may include a first or bottom conductive layer 702, a second or top conductive layer (not shown), a dielectric layer 704 between the first and second conductive layers, a plurality of conductive sidewalls 706-715, and a plurality of conductive structures 716. The first and second conductive layers may be substantially parallel and may extend horizontally in the x-y direction. The plurality of conductive sidewalls 706-715 may extend vertically in the x-z direction. The plurality of conductive sidewalls 706-715 may be arranged to form four channels or ports, including a first port 720, a second port 722, a third port 724, and a fourth port 726, for the transmission of an electromagnetic wave signal. The plurality of conductive sidewalls 706-715 may be continuous structures having vertical sides that are planar. The plurality of conductive sidewalls 706-715 may extend through the dielectric layer 704 to connect or be in contact with the first and second conductive layers. The plurality of conductive structures 716 may have any suitable size, shape, number, and arrangement for dividing an electromagnetic signal into one or more frequencies. For example, as shown in FIG. 7, the plurality of conductive structures 716 may be arranged to split or divide an electromagnetic wave signal into three different frequency bands. In some embodiments, as shown in FIG. 7, the plurality of conductive structures 716 may include vertical fins. In some embodiments, the plurality of conductive structures 716 may include ridges and/or vertical posts. For example, an electromagnetic wave signal may enter at the first port 720 of the SIW triplexer and may propagate through the plurality of conductive structures 716, which may divide the signal into three frequency bands, such that a first part of the signal exits at the second port 722, a second part of the signal exits at the third port 724, and a third part of the signal exits at the fourth port 726. In some embodiments, any portion of the signal that reaches conductive sidewall 715 (e.g., not filtered during a first propagation) may be reflected back to be filtered. Although FIG. 7 illustrates the SIW triplexer having one input port and three output ports, these ports may change depending on whether a signal is being combined or separated, such that the three output ports may become three input ports and the input port may become an output port. Moreover, although FIG. 7 shows the plurality of conductive sidewalls as having a thickness equal to a single dielectric layer, the plurality of conductive sidewalls as well as the plurality of conductive structures may have any suitable thickness and may span two or more dielectric layers of the package substrate. Although FIGS. 6 and 7 show particular SIW components, any SIW component may be formed using the techniques described herein.

Figure 8:
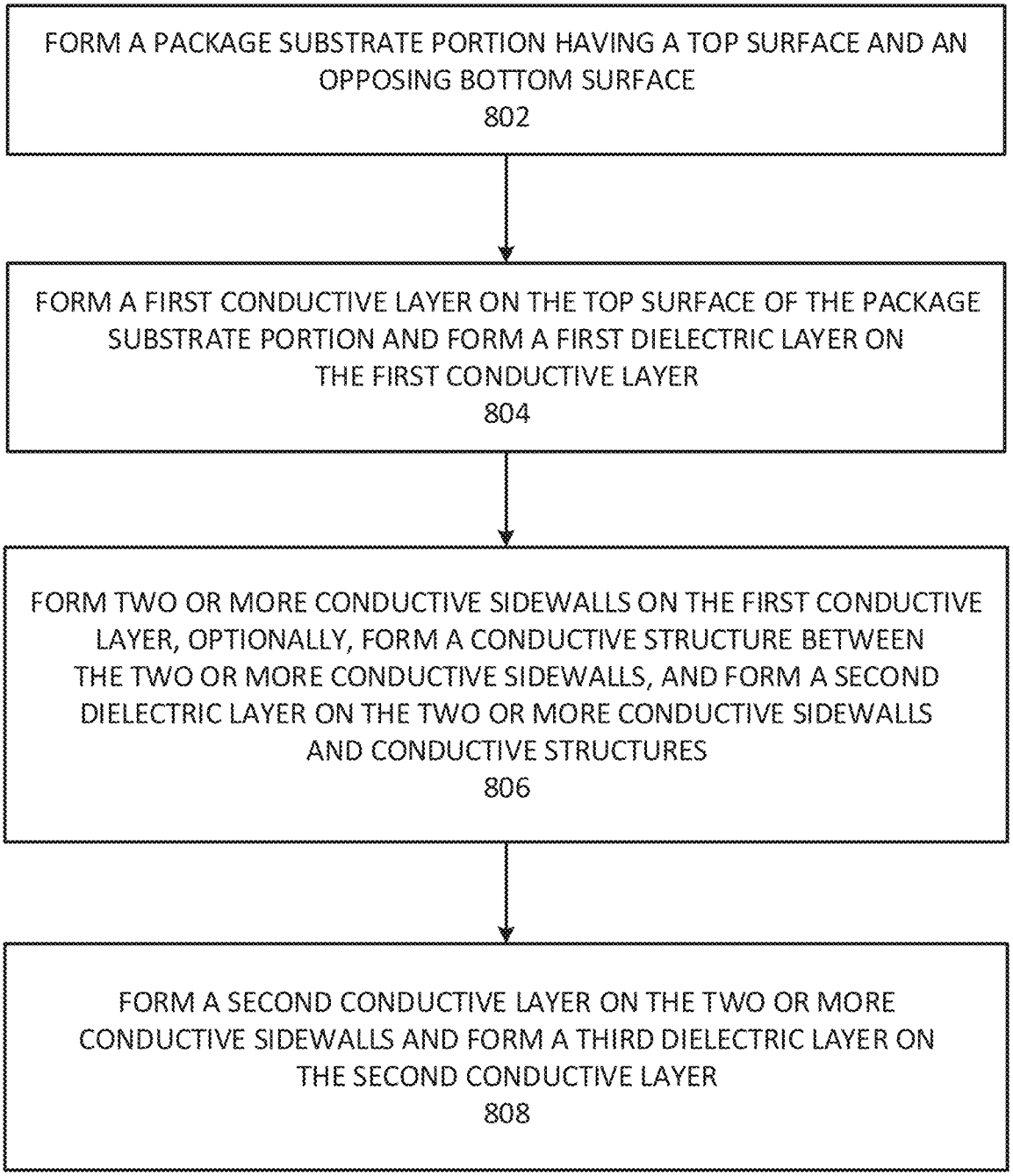
FIG. 8 is a process flow diagram of an example method of forming an SIW component, in accordance with various embodiments.

FIG. 8 is a process flow diagram of an example method of forming an SIW component, in accordance with various embodiments. At block 802, including individually labeled posts 408A, 408B, and 408C (FIG. 4A), a portion of a package substrate may be formed. The top surface of the package substrate portion may be the layer for integrating the SIW component or the SIW filter. The package substrate portion may have bottom surface conductive contacts for coupling the package substrate portion to a circuit board.

At block 804, a first conductive layer of an SIW component may be patterned and deposited on the top surface of the package substrate portion. In some embodiments, the first conductive layer may be formed by depositing and patterning a photoresist material on the top surface of the package substrate portion to create an opening, depositing a conductive material in the opening, and removing the photoresist material. In some embodiments, the first conductive layer may include a slot or iris for coupling an SIW component to an other SIW component. In some embodiments, a seed layer may be deposited on the top surface of the package substrate portion prior to depositing the photoresist material. A dielectric layer may be formed on the first conductive layer. If necessary, dielectric material may be removed to expose the top surface of the first conductive layer.

At block 806, two or more conductive sidewalls may be patterned and deposited on the first conductive layer, wherein the two or more conductive sidewalls are continuous structures, and in some embodiments, may have vertical sides that are substantially planar. In some embodiments, the conductive sidewalls may be patterned, for example, in an SIW combiner or multiplexer, to direct a signal for coupling or dividing. In some embodiments, a conductive structure may be patterned and deposited on the first conductive layer between the two or more conductive sidewalls. In some embodiments, the two or more sidewalls may have vertical sides that are angled (e.g., v-shaped) rather than parallel. In some embodiments, for example when forming an SIW filter, a first conductive sidewall and an opposing second conductive sidewall may be formed. In some embodiments, for example when forming an SIW diplexer, more than two conductive sidewalls may be formed to create three channels (e.g., an input port and two output ports). In some embodiments, for example when forming a diplexer, the conductive structure may be a set of vertical posts for dividing or combining a signal by frequency. In some embodiments, for example when forming an SIW filter, the conductive structure may be a ridge or vertical post for creating a resonant cavity. In some embodiments, for example when forming an SIW filter, the conductive structure may be a ridge along the length of the SIW. In some embodiments a combination of the described conductive structures may be employed. In some embodiments, the two or more conductive sidewalls and the conductive structure may be formed by depositing and patterning a photoresist material on the top surface of the package substrate portion to create an opening, depositing a conductive material in the opening, and removing the photoresist material. In some embodiments, a seed layer may be deposited on the top surface of the package substrate portion prior to depositing the photoresist material. A second dielectric layer may be formed over the two or more conductive sidewalls and the conductive structure. If necessary, the second dielectric layer may be removed, for example, by planarization or grinding, to expose the top surface of the two or more conductive sidewalls and the top surface of the conductive structure.

At block 808, a second conductive layer may be patterned and deposited on the two or more conductive sidewalls and the conductive structure. In some embodiments, the second conductive layer may be formed by depositing and patterning a photoresist material on the top surface of the package substrate portion to create an opening, depositing a conductive material in the opening, and removing the photoresist material. In some embodiments, the second conductive layer may include a slot or iris for coupling an SIW component to an other SIW component. In some embodiments, a seed layer may be deposited on the top surface of the package substrate portion prior to depositing the photoresist material. A third dielectric layer may be formed over the second conductive layer. If necessary, dielectric material may be removed to expose the top surface of the second conductive layer.

Additional conductive layers and dielectric layers may be formed by repeating the process as described in block 804 through block 808. Further operations may be performed for the SIW component, such as coupling an input feed to the input end and coupling an output feed to the output end. The finished substrate may be a single package substrate or may be a repeating unit that may undergo a singulation process in which each unit is separated for one another to create a single package substrate. Further operations may be performed as suitable (e.g., attaching additional dies to the package substrate, attaching solder balls for coupling to a circuit board, etc.).

The lithographically-defined SIW components disclosed herein may be included in microelectronic assemblies coupled to one or more dies to be used for any suitable application. For example, in some embodiments, a microelectronic assembly having a lithographically-defined SIW may be used to provide an ultra-high density and high bandwidth interconnect for field programmable gate array (FPGA) transceivers and amplifiers from groups III-V.

In an example, a microelectronic assembly having a lithographically-defined SIW component may be coupled to a first die that may include a processing device (e.g., a central processing unit, an RF chip, a power converter, a network processor, a graphics processing unit, a FPGA, a modem, an applications processor, etc.), and a second die that may include high bandwidth memory, transceiver circuitry, and/or input/output circuitry (e.g., Double Data Rate transfer circuitry, Peripheral Component Interconnect Express circuitry, etc.).

In another example, a microelectronic assembly having a lithographically-defined SIW component may include a first die that may be a cache memory (e.g., a third level cache memory), and one or more dies that may be processing devices (e.g., a central processing unit, an RF chip, a power converter, a network processor, a graphics processing unit, a FPGA, a modem, an applications processor, etc.) that share the cache memory of the first die.

In another example, a microelectronic assembly having a lithographically-defined SIW component (e.g., a diplexer, a triplexer, a splitter, or a combiner) may include an RF die, an RF front end, and an ultra-high density and high bandwidth wireline interconnect, such as an RF transmission line, an RF cable, an RF waveguide, or a dielectric waveguide.

Figure 9:
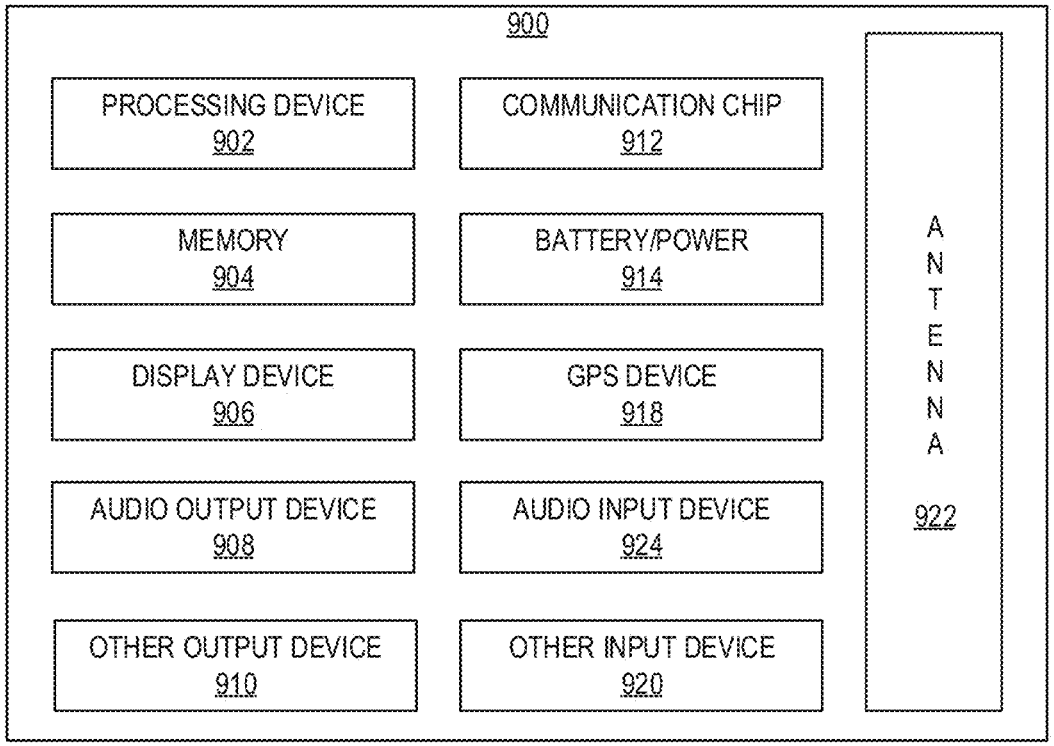
FIG. 9 is a block diagram of an example electrical device that may include a microelectronic assembly having an SIW, in accordance with any of the embodiments disclosed herein.

The microelectronic assemblies disclosed herein may be included in any suitable electronic component. FIG. 9 is a block diagram of an example electrical device 900 that may include one or more of the microelectronic assemblies disclosed herein. A number of components are illustrated in FIG. 9 as included in the electrical device 900, but any one or more of these components may be omitted or duplicated, as suitable for the application. In some embodiments, some or all of the components included in the electrical device 900 may be attached to one or more motherboards. In some embodiments, some or all of these components are fabricated onto a single system-on-a-chip (SoC) die.

Additionally, in various embodiments, the electrical device 900 may not include one or more of the components illustrated in FIG. 9, but the electrical device 900 may include interface circuitry for coupling to the one or more components. For example, the electrical device 900 may not include a display device 906, but may include display device interface circuitry (e.g., a connector and driver circuitry) to which a display device 906 may be coupled. In another set of examples, the electrical device 900 may not include an audio input device 924 or an audio output device 908, but may include audio input or output device interface circuitry (e.g., connectors and supporting circuitry) to which an audio input device 924 or audio output device 908 may be coupled.

The electrical device 900 may include a processing device 902 (e.g., one or more processing devices). As used herein, the term "processing device" or "processor" may refer to any device or portion of a device that processes electronic data from registers and/or memory to transform that electronic data into other electronic data that may be stored in registers and/or memory. The processing device 902 may include one or more digital signal processors (DSPs), application-specific integrated circuits (ASICs), CPUs, graphics processing units (GPUs), cryptoprocessors (specialized processors that execute cryptographic algorithms within hardware), server processors, or any other suitable processing devices. The electrical device 900 may include a memory 904, which may itself include one or more memory devices such as volatile memory (e.g., dynamic random access memory (DRAM)), nonvolatile memory (e.g., read-only memory (ROM)), flash memory, solid state memory, and/or a hard drive. In some embodiments, the memory 904 may include memory that shares a die with the processing device 902. This memory may be used as cache memory and may include embedded dynamic random access memory (eDRAM) or spin transfer torque magnetic random access memory (STT-MRAM).

In some embodiments, the electrical device 900 may include a communication chip 912 (e.g., one or more communication chips). For example, the communication chip 912 may be configured for managing wireless communications for the transfer of data to and from the electrical device 900. The term "wireless" and its derivatives may be used to describe circuits, devices, systems, methods, techniques, communications channels, etc., that may communicate data through the use of modulated electromagnetic radiation through a nonsolid medium. The term does not imply that the associated devices do not contain any wires, although in some embodiments they might not.

The communication chip 912 may implement any of a number of wireless standards or protocols, including but not limited to Institute of Electrical and Electronic Engineers (IEEE) standards including Wi-Fi (IEEE 802.11 family), IEEE 802.16 standards (e.g., IEEE 802.16-2005 Amendment), 3rd Generation Partnership Project (3GPP) Long-Term Evolution (LTE), 5G, 5G New Radio, along with any amendments, updates, and/or revisions (e.g., advanced LTE project, ultra-mobile broadband (UMB) project (also referred to as "3GPP2"), etc.). IEEE 802.16 compatible Broadband Wireless Access (BWA) networks are generally referred to as WiMAX networks, an acronym that stands for Worldwide Interoperability for Microwave Access, which is a certification mark for products that pass conformity and interoperability tests for the IEEE 802.16 standards. The communication chip 912 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication chip 912 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chip 912 may operate in accordance with Code Division Multiple Access (CDMA), Time Division Multiple Access (TDMA), Digital Enhanced Cordless Telecommunications (DECT), Evolution-Data Optimized (EV-DO), and derivatives thereof, as well as any other wireless protocols that are designated as 3G, 4G, 5G, and beyond. The communication chip 912 may operate in accordance with other wireless protocols in other embodiments. The electrical device 900 may include an antenna 922 to facilitate wireless communications and/or to receive other wireless communications (such as AM or FM radio transmissions).

In some embodiments, the communication chip 912 may manage wired communications, such as electrical, optical, or any other suitable communication protocols (e.g., the Ethernet). As noted above, the communication chip 912 may include multiple communication chips. For instance, a first communication chip 912 may be dedicated to shorter-range wireless communications such as Wi-Fi or Bluetooth, and a second communication chip 912 may be dedicated to longer-range wireless communications such as global positioning system (GPS), EDGE, GPRS, CDMA, WiMAX, LTE, EV-DO, or others. In some embodiments, a first communication chip 912 may be dedicated to wireless communications, and a second communication chip 912 may be dedicated to wired communications.

The electrical device 900 may include battery/power circuitry 914. The battery/power circuitry 914 may include one or more energy storage devices (e.g., batteries or capacitors) and/or circuitry for coupling components of the electrical device 900 to an energy source separate from the electrical device 900 (e.g., AC line power).

The electrical device 900 may include a display device 906 (or corresponding interface circuitry, as discussed above). The display device 906 may include any visual indicators, such as a heads-up display, a computer monitor, a projector, a touchscreen display, a liquid crystal display (LCD), a light-emitting diode display, or a flat panel display.

The electrical device 900 may include an audio output device 908 (or corresponding interface circuitry, as discussed above). The audio output device 908 may include any device that generates an audible indicator, such as speakers, headsets, or earbuds.

The electrical device 900 may include an audio input device 924 (or corresponding interface circuitry, as discussed above). The audio input device 924 may include any device that generates a signal representative of a sound, such as microphones, microphone arrays, or digital instruments (e.g., instruments having a musical instrument digital interface (MIDI) output).

The electrical device 900 may include a GPS device 918 (or corresponding interface circuitry, as discussed above). The GPS device 918 may be in communication with a satellite-based system and may receive a location of the electrical device 900, as known in the art.

The electrical device 900 may include another output device 910 (or corresponding interface circuitry, as discussed above). Examples of the other output device 910 may include an audio codec, a video codec, a printer, a wired or wireless transmitter for providing information to other devices, or an additional storage device.

The electrical device 900 may include another input device 920 (or corresponding interface circuitry, as discussed above). Examples of the other input device 920 may include an accelerometer, a gyroscope, a compass, an image capture device, a keyboard, a cursor control device such as a mouse, a stylus, a touchpad, a bar code reader, a Quick Response (QR) code reader, any sensor, or a radio frequency identification (RFID) reader.

The electrical device 900 may have any desired form factor, such as a hand-held or portable computing device (e.g., a cell phone, a smart phone, a mobile internet device, a music player, a tablet computer, a laptop computer, a netbook computer, an ultrabook computer, a personal digital assistant (PDA), an ultra-mobile personal computer, etc.), a desktop electrical device, a server device or other networked computing component, a printer, a scanner, a monitor, a set-top box, an entertainment control unit, a vehicle control unit, a digital camera, a digital video recorder, or a wearable electrical/computing device. In some embodiments, the electrical device 900 may be any other electronic device that processes data.

The following paragraphs provide various examples of the embodiments disclosed herein.

Example 1 is a microelectronic assembly, including: a package substrate portion having a first surface and an opposing second surface; and a substrate integrated waveguide (SIW) filter, including: a first conductive layer on the first surface of the package substrate portion; a dielectric layer on the first conductive layer; a second conductive layer on the dielectric layer; a first conductive sidewall and an opposing second conductive sidewall, wherein the first and second conductive sidewalls are continuous structures in the dielectric layer; and a plurality of resonator cavities in the dielectric layer between the first and second conductive sidewalls.

Example 2 may include the subject matter of Example 1, and may further specify that the plurality of resonator cavities is formed by a plurality of vertical conductive posts in the dielectric layer between the first and second conductive sidewalls.

Example 3 may include the subject matter of Example 2, and may further specify that an individual one of the plurality of vertical conductive posts has a cross-section that is circular.

Example 4 may include the subject matter of Example 2, and may further specify that an individual one of the plurality of vertical conductive posts has a cross-section that is non-circular.

Example 5 may include the subject matter of Example 2, and may further specify that the plurality of vertical conductive posts has a linear arrangement.

Example 6 may include the subject matter of Example 2, and may further specify that the plurality of vertical conductive posts has a non-linear arrangement.

Example 7 may include the subject matter of Example 1, and may further specify that the plurality of resonator cavities is formed by a plurality of ridges in the dielectric layer between the first and second conductive sidewalls.

Example 8 may include the subject matter of Example 7, and may further specify that the plurality of resonator cavities is arranged in a series of coupled resonator cavities, and wherein the coupled resonator cavities are coupled by irises.

Example 9 may include the subject matter of Example 1, and may further specify that the dielectric layer is a first dielectric layer, and may further include a second dielectric layer, wherein the first and second conductive sidewalls span the first and second dielectric layers.

Example 10 may include the subject matter of Example 1, and may further specify that the first and second conductive sidewalls are cuboidal with planar vertical sides.

Example 11 may include the subject matter of Example 1, and may further include: an input port at a first end of the first and second conductive layers to receive an electromagnetic signal; an input feed coupled to the input port; an output port at a second end of the first and second conductive layers to transmit an electromagnetic signal; and an output feed coupled to the output port.

Example 12 may include the subject matter of Example 11, and may further specify that the input feed includes a microstrip-to-SIW transition, a microstrip-to-slot transition, a stripline-to-SIW transition, a waveguide launcher structure, a radio frequency (RF) connector, or an electromagnetic radiating structure.

Example 13 may include the subject matter of Example 11, and may further specify that the output feed includes a microstrip-to-SIW transition, a microstrip-to-slot transition, a stripline-to-SIW transition, a waveguide launcher structure, a radio frequency (RF) connector, or an electromagnetic radiating structure.

Example 14 may include the subject matter of Example 11, and may further specify that the electromagnetic signal has a frequency equal to or greater than 100 GHz.

Example 15 may include the subject matter of Example 11, and may further specify that the electromagnetic signal has a frequency equal to or greater than 150 GHz.

Example 16 may include the subject matter of Example 1, and may further specify that the SIW filter is a first SIW filter, and may further include: a second SIW filter, including: a first conductive layer; a dielectric layer on the first conductive layer; a second conductive layer on the dielectric layer; a first conductive sidewall and an opposing second conductive sidewall, wherein the first and second conductive sidewalls are continuous structures in the dielectric layer; and a plurality of resonator cavities in the dielectric layer between the first and second conductive sidewalls.

Example 17 may include the subject matter of Example 16, and may further specify that the first conductive layer of the first SIW filter and the first conductive layer on the second SIW filter are a same conductive layer of the package substrate portion.

Example 18 may include the subject matter of Example 16, and may further specify that the first conductive layer of the first SIW filter and the first conductive layer on the second SIW filter are different conductive layers of the package substrate portion.

Example 19 may include the subject matter of Example 16, and may further specify that the first SIW filter and the second SIW filter are coupled via a slot or an iris.

Example 20 may include the subject matter of Example 1, and may further specify that the microelectronic assembly is included in a server device.

Example 21 may include the subject matter of Example 1, and may further specify that the microelectronic assembly is included in a portable computing device.

Example 22 may include the subject matter of Example 1, and may further specify that the microelectronic assembly included in a wearable computing device.

Example 23 is a microelectronic assembly, including: a package substrate portion having a first surface and an opposing second surface; and a substrate integrated waveguide (SIW) component, including: a first conductive layer on the first surface of the package substrate portion; a dielectric layer, on the first conductive layer, having a plurality of conductive sidewalls, wherein the plurality of conductive sidewalls are continuous structures; and a second conductive layer on the dielectric layer.

Example 24 may include the subject matter of Example 23, and may further specify that the dielectric layer is a first dielectric layer, and may further include a second dielectric layer, wherein the plurality of conductive sidewalls spans the first and second dielectric layers.

Example 25 may include the subject matter of Example 23, and may further specify that an individual one of the plurality of conductive sidewalls is cuboidal with planar vertical sides.

Example 26 may include the subject matter of Example 23, and may further include: a plurality of conductive structures in the dielectric layer between the plurality of conductive sidewalls to divide an electromagnetic signal into one or more frequency bands.

Example 27 may include the subject matter of Example 26, and may further specify that the plurality of conductive structures include a vertical post, a ridge, or a vertical fin.

Example 28 may include the subject matter of Example 23, and may further specify that the plurality of conductive sidewalls forms an input port to receive an electromagnetic signal, and a first output port and a second output port to transmit an electromagnetic signal, and may further include: an input feed coupled to the input port; a first output feed coupled to the first output port; and a second output feed coupled to the second output port.

Example 29 may include the subject matter of Example 28, and may further specify that the input feed includes a microstrip-to-SIW transition, a microstrip-to-slot transition, a stripline-to-SIW transition, a waveguide launcher structure, a radio frequency (RF) connector, or an electromagnetic radiating structure.

Example 30 may include the subject matter of Example 28, and may further specify that the first or the second output feed includes a microstrip-to-SIW transition, a microstrip-to-slot transition, a stripline-to-SIW transition, a waveguide launcher structure, a radio frequency (RF) connector, or an electromagnetic radiating structure.

Example 31 may include the subject matter of Example 28, and may further specify that the electromagnetic signal has a frequency equal to or greater than 100 GHz.

Example 32 may include the subject matter of Example 28, and may further specify that the electromagnetic signal has a frequency equal to or greater than 150 GHz.

Example 33 may include the subject matter of Example 23, and may further specify that the microelectronic assembly is included in a server device.

Example 34 may include the subject matter of Example 23, and may further specify that the microelectronic assembly is included in a portable computing device.

Example 35 may include the subject matter of Example 23, and may further specify that the microelectronic assembly included in a wearable computing device.

Example 36 is a method of manufacturing a microelectronic assembly having a SIW component, including: forming a package substrate portion, wherein the package substrate portion has a first surface and an opposing second surface; forming a first conductive layer on the first surface of the package substrate portion; forming a first dielectric layer on the first conductive layer; forming a first conductive sidewall and an opposing second conductive sidewall on the first conductive layer, wherein the first and second conductive sidewalls are continuous structures; forming a second dielectric layer on the first and second conductive sidewalls; and forming a second conductive layer on the first and second conductive sidewalls.

Example 37 may include the subject matter of Example 36, and may further specify that forming the first and second conductive sidewalls comprises: depositing a photoresist layer on the first conductive layer; forming two openings in the photoresist layer; depositing conductive material in the two openings to form the first and second conductive sidewalls; and removing the photoresist layer.

Example 38 may include the subject matter of Example 37, and may further specify that forming the two or more conductive sidewalls further comprises: depositing a seed layer on the first conductive layer before depositing the photoresist layer.

Example 39 may include the subject matter of Example 36, and may further specify that the first and second conductive sidewalls are cuboidal with planar vertical sides.

Example 40 may include the subject matter of Example 36, and may further include: forming a plurality of conductive structures in the second dielectric layer between the first and second conductive sidewalls to form a plurality of resonant cavities.

The invention claimed is:

1. A microelectronic assembly, comprising:

a package substrate portion having a first surface and an opposing second surface, the package substrate portion including conductive lines and vias through a dielectric material; and a stacked structure overlaying the package substrate portion at the second surface, the stacked structure comprising:

a first conductive layer on the second surface of the package substrate portion;

a dielectric layer on the first conductive layer;

a second conductive layer on the dielectric layer;

a first conductive sidewall and an opposing second conductive sidewall in the dielectric layer, wherein the first and second conductive sidewalls are continuous structures, and wherein the first and second conductive sidewalls are connected to the first conductive layer at a bottom side and connected to the second conductive layer at a top side; and a plurality of cavities in the dielectric layer between the first and second conductive sidewalls.

2. The microelectronic assembly of claim 1, wherein the plurality of cavities is formed by a plurality of vertical conductive posts in the dielectric layer between the first and second conductive sidewalls.

3. The microelectronic assembly of claim 2, wherein at least one of the plurality of vertical conductive posts has a cross-section that is circular.

4. The microelectronic assembly of claim 2, wherein at least one of the plurality of vertical conductive posts has a cross-section that is non-circular.

5. The microelectronic assembly of claim 1, wherein the plurality of cavities is formed by a plurality of ridges in the dielectric layer between the first and second conductive sidewalls.

6. The microelectronic assembly of claim 5, wherein the plurality of cavities is arranged in a series of coupled cavities.

7. The microelectronic assembly of claim 1, wherein the dielectric layer is a first dielectric layer, further comprising a second dielectric layer on the first dielectric layer, wherein the first and second conductive sidewalls are continuous structures in the first and second dielectric layers.

8. The microelectronic assembly of claim 1, wherein the first and second conductive sidewalls are cuboidal with planar vertical sides.

9. The microelectronic assembly of claim 1, further comprising:

an input port at a first end of the first and second conductive layers to receive the electromagnetic signal;

an input feed coupled to the input port;

an output port at a second end of the first and second conductive layers to transmit the electromagnetic signal; and an output feed coupled to the output port.

10. The microelectronic assembly of claim 9, wherein the input feed includes a signal feeding mechanism, a waveguide launcher structure, a radio frequency (RF) connector, or an electromagnetic radiating structure.

11. The microelectronic assembly of claim 9, wherein the electromagnetic signal has a frequency equal to or greater than 100 GHz.

12. The microelectronic assembly of claim 1, wherein the stacked structure is a first stacked structure, and further comprising:

a second stacked structure overlaying the package substrate portion at the second surface, the second stacked structure comprising:

a first conductive layer on the second surface of the package substrate portion;

a dielectric layer on the first conductive layer;

a second conductive layer on the dielectric layer;

a first conductive sidewall and an opposing second conductive sidewall in the dielectric layer, wherein the first and second conductive sidewalls are continuous structures, and wherein the first and second conductive sidewalls are connected to the first conductive layer at a bottom side and connected to the second conductive layer at a top side; and a plurality of cavities in the dielectric layer between the first and second conductive sidewalls.

13. The microelectronic assembly of claim 12, wherein the first stacked structure and the second stacked structure are coupled via an opening in the second conductive layer of the first stacked structure and in the first conductive layer of the second stacked structure.

14. The microelectronic assembly of claim 1, wherein the microelectronic assembly is included in a portable computing device.

15. A microelectronic assembly, comprising:

a package substrate portion having a first surface and an opposing second surface, the package substrate portion including conductive lines and vias through a dielectric material; and a component overlaying the package substrate portion at the second surface, the component comprising:

a first conductive layer on the second surface of the package substrate portion;

a dielectric layer, on the first conductive layer, including a plurality of conductive sidewalls, wherein the plurality of conductive sidewalls are continuous structures in the dielectric layer; and a second conductive layer on the dielectric layer, wherein the plurality of conductive sidewalls are connected to the first conductive layer at a bottom side and connected to the second conductive layer at a top side.

16. The microelectronic assembly of claim 15, further comprising:

a plurality of conductive structures in the dielectric layer between the plurality of conductive sidewalls to divide an electromagnetic signal into one or more frequency bands.

17. The microelectronic assembly of claim 16, wherein the plurality of conductive structures includes a vertical post, a ridge, or a vertical fin.

18. The microelectronic assembly of claim 15, wherein the plurality of conductive sidewalls forms an input port to receive the electromagnetic signal, and a first output port and a second output port to transmit the electromagnetic signal, and further comprising:

an input feed coupled to the input port;

a first output feed coupled to the first output port; and a second output feed coupled to the second output port.

19. The microelectronic assembly of claim 18, wherein the input feed includes a signal feeding mechanism, a waveguide launcher structure, a radio frequency (RF) connector, or an electromagnetic radiating structure.

20. The microelectronic assembly of claim 18, wherein the first or the second output feed includes a signal feeding mechanism, a waveguide launcher structure, a radio frequency (RF) connector, or an electromagnetic radiating structure.

* * * * *